US010204715B2

(12) United States Patent
Holzmueller et al.

(10) Patent No.: US 10,204,715 B2
(45) Date of Patent: Feb. 12, 2019

(54) SUBMERSIBLE POWER CABLE

(71) Applicant: Schlumberger Technology Corporation, Sugar Land, TX (US)

(72) Inventors: Jason Holzmueller, Lawrence, KS (US); Jinglei Xiang, Lawrence, KS (US); Christopher Von Fange, Lawrence, KS (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/221,353

(22) Filed: Jul. 27, 2016

(65) Prior Publication Data

US 2017/0287595 A1 Oct. 5, 2017

Related U.S. Application Data

(60) Provisional application No. 62/316,176, filed on Mar. 31, 2016.

(51) Int. Cl.

| | |
|---|---|
| ***H01B 7/04*** | (2006.01) |
| ***H01B 7/02*** | (2006.01) |
| ***H01B 7/29*** | (2006.01) |
| ***H01B 7/28*** | (2006.01) |
| ***H01B 7/18*** | (2006.01) |
| ***H01B 3/30*** | (2006.01) |
| ***H01B 13/14*** | (2006.01) |

(Continued)

(52) U.S. Cl.

CPC ..... *H01B 7/046* (2013.01); *F04B 17/03* (2013.01); *F04B 43/023* (2013.01); *F04B 43/04* (2013.01); *F04B 47/06* (2013.01); *F04D 13/0693* (2013.01); *F04D 13/086* (2013.01); *F04D 29/22* (2013.01); *H01B 3/307* (2013.01); *H01B 7/0275* (2013.01); *H01B 7/18* (2013.01); *H01B 7/2813* (2013.01); *H01B 7/29* (2013.01); *H01B 13/14* (2013.01); *H01B 13/24* (2013.01)

(58) Field of Classification Search

None

See application file for complete search history.

(56) References Cited

U.S. PATENT DOCUMENTS 4,472,597 A * 9/1984 Uematsu ..... H01B 9/02 174/106 R
5,559,169 A * 9/1996 Belmont ..... C08K 9/04 523/215

(Continued)

FOREIGN PATENT DOCUMENTS

CN 103408855 11/2013

OTHER PUBLICATIONS

Tolliver, J.S., et al "Diffusion into a Hollow Cylinder" Oak Ridge National Laboratory, Oct. 1978, 35 pgs.

(Continued)

*Primary Examiner* — William H Mayo, III
*Assistant Examiner* — Krystal Robinson

(57) ABSTRACT

A power cable can include a conductor; an insulation layer disposed about the conductor where the insulation layer includes a first polymeric material; and a shield layer disposed about the insulation layer where the shield layer includes a second polymeric material where a solubility parameter of the first polymeric material is less than a solubility parameter of the second polymeric material.

16 Claims, 14 Drawing Sheets

(51) Int. Cl.

| | |
|---|---|
| ***H01B 13/24*** | (2006.01) |
| ***F04B 43/02*** | (2006.01) |
| ***F04B 43/04*** | (2006.01) |
| ***F04B 47/06*** | (2006.01) |
| ***F04D 13/08*** | (2006.01) |
| ***F04D 29/22*** | (2006.01) |
| ***F04D 13/06*** | (2006.01) |
| ***F04B 17/03*** | (2006.01) |

(56) References Cited

U.S. PATENT DOCUMENTS

| | | | | |
|---|---|---|---|---|
| 9,543,056 | B2 * | 1/2017 | Svanberg | H01B 1/24 |
| 2003/0159824 | A1 * | 8/2003 | Frederic | H01B 7/0072 166/250.01 |
| 2007/0012468 | A1 * | 1/2007 | Han | H01B 1/24 174/34 |
| 2007/0142547 | A1 * | 6/2007 | Vaidya | E21B 33/1208 524/847 |
| 2010/0147188 | A1 * | 6/2010 | Mamak | B82Y 30/00 106/31.13 |
| 2010/0147505 | A1 * | 6/2010 | Manke | F04B 47/06 166/66.4 |
| 2013/0306348 | A1 * | 11/2013 | Holzmueller | H01B 9/02 174/105 R |

OTHER PUBLICATIONS

Cabot, Brochure VULCAN XC72 Conductive Carbon Black, 2015 (2 pages).

Fondeur, Miscibility Evaluation of the Next Generation Solvent with Polymers Currently Used at DWPF, MCU, and Saltstone, Savannah River National Laboratory (SRNL), Apr. 2013 (25 pages).

Drzal, Lawrence T., PhD, "Graphene Nanoplatelets: A Multifunctional Nanomaterial Additive for Polymers and Composites" Professor, Chem Engin and Materials Science, Michigan State University, East Lansing, MI, 33 pgs.

XG Sciences, About XGNP Graphene Nanoplatelets, http://xgsciences.com/products/graphene-nanoplatelets/, 2016 (1 page).

Kalaitzidou et al., Multifunctional polypropylene composites produced by incorporation of exfoliated graphite nanoplatelets—Carbon, vol. 45, Issue 7, Jun. 2007, pp. 1446-1452, Abstract (1 page).

Kalaitzidou et al., Mechanical properties and morphological characterization of exfoliated graphite-polypropylene nanocomposites—Composites Part A: Applied Science and Manufacturing, vol. 38, Issue 7, Jul. 2007, pp. 1675-1682, Abstract (1 page).

Kalaitzidou et al., The nucleating effect of exfoliated graphite nanoplatelets and their influence on the crystal structure and electrical conductivity of polypropylene nanocomposites J. Mater. Sci., 43, 2895-2907 (2008), Abstract (1 page).

Jiang et al., Multifunctional high density polyethylene nanocomposites produced by incorporation of exfoliated graphite nanoplatelets 1: Morphology and mechanical properties, Polymer Composites, vol. 31, Issue 6, pp. 1091-1098, Jun. 2010, Abstract (1 page).

Kim et al., Improvement of electric conductivity of LLDPE based nanocomposite by paraffin coating on exfoliated graphite nanoplatelets, Composites Part A: Applied Science and Manufacturing, vol. 41, Issue 5, May 2010, pp. 581-587, Abstract (1 page).

Liu et al., Influence of Processing on Morphology, Electrical Conductivity and Flexural Properties of Exfoliated Graphite Nanoplatelets-Polyamide Nanocomposites—Carbon Lett., vol. 11, No. 4 Dec. 2010 pp. 279-284 (6 pages).

Via et al., Electrical conductivity modeling of carbon black/polycarbonate, carbon nanotube/polycarbonate, and exfoliated graphite nanoplatelet/polycarbonate composites, Journal of Applied Polymer Science vol. 124, Issue 1, pp. 182-189, Apr. 5, 2012, Abstract (1 page).

Paddock, A new environmental accountability system for the nanotechnology industry, NSTI-Nanotech 2006, www.nsti.org, ISBN 0-9767985-6-5 vol. 1, 2006 (4 pages).

Patsidis, Dielectric response, functionality and energy storage in epoxy nanocomposites: Barium titanate vs exfoliated graphite nanoplatelets, Materials Chemistry and Physics, vol. 135, Issues 2-3, Aug. 15, 2012, pp. 798-805, Abstract (1 page).

Potts et al., Processing—morphology—property relationships and composite theory analysis of reduced graphene oxide/natural rubber nanocomposites—Macromolecules, 45, 6045-6055, 2012, Abstract (1 page).

Zhan et al., Dispersion and Exfoliation of Graphene in Rubber by an Ultrasonically-Assisted Latex Mixing and In situ Reduction Process, Macromol. Mater. Eng., 296: 590-602, Abstract (2 pages).

Kuilla et al., Recent Advances in Graphene Based Polymer Composites—Progress in polymer science, 35 (2010) 1350-1375 (26 pages).

Ozbas et al., Strain-Induced Crystallization and Mechanical Properties of Functionalized Graphene Sheet-Filled Natural Rubber J. of Polymer science Part B: Polymer Physics 2012, 50, 718-723 (6 pages).

* cited by examiner

SUBMERSIBLE POWER CABLE

RELATED APPLICATIONS

This application claims priority to and the benefit of a US provisional application having Ser. No. 62/316,176, filed 31 Mar. 2016, which is incorporated by reference herein.

BACKGROUND

Equipment used in the oil and gas industry may be exposed to high-temperature and/or high-pressure environments. Such environments may also be chemically harsh, for example, consider environments that may include chemicals such as hydrogen sulfide, carbon dioxide, etc. Such environments can include one or more types of fluids where, for example, equipment may be at least partially submersed in the one or more types of fluids. Various types of environmental conditions can damage equipment.

SUMMARY

A power cable can include a conductor; an insulation layer disposed about the conductor where the insulation layer includes a first polymeric material; and a shield layer disposed about the insulation layer where the shield layer includes a second polymeric material where a solubility parameter of the first polymeric material is less than a solubility parameter of the second polymeric material. A method can include translating a conductor in an extruder; depositing an insulation layer about the conductor where the insulation layer includes a first polymeric material; and depositing a shield layer about the insulation layer where the shield layer includes a second polymeric material where a solubility parameter of the first polymeric material is less than a solubility parameter of the second polymeric material. An electric submersible pump can include an electric motor; a pump operatively coupled to the electric motor; and a power cable that includes a conductor electrically coupled to the electric motor; an insulation layer disposed about the conductor where the insulation layer includes a first polymeric material; and a shield layer disposed about the insulation layer where the shield layer includes a second polymeric material where a solubility parameter of the first polymeric material is less than a solubility parameter of the second polymeric material. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

Figure 1:
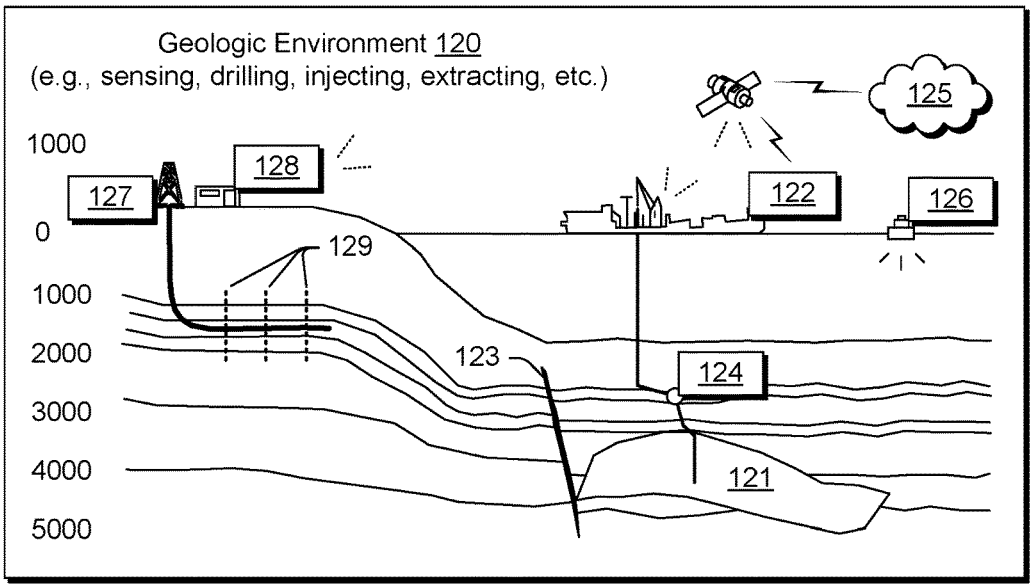
FIG. 1 illustrates examples of equipment in geologic environments.
Figure 1:
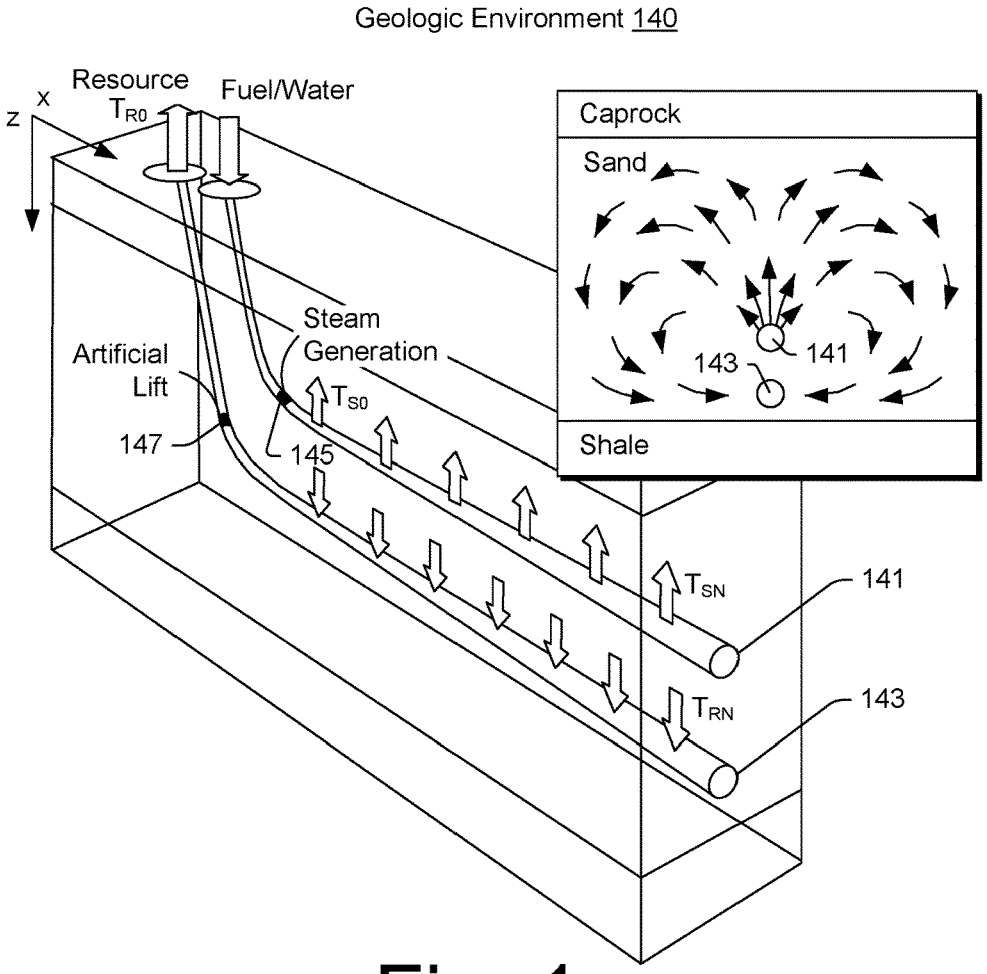

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

As an example, a cable that includes an electrical conductor can include insulation that electrically insulates at least a portion of the electrical conductor, for example, along a length of the electrical conductor, which may be in the form of a wire (e.g., solid, stranded, etc.). In such an example, a shield may be disposed about the insulation where the shield can optionally be bound to the insulation. In such an example, the insulation and the shield can include polymeric materials where a polymeric material of the insulation differs from a polymeric material of the shield. For example, consider an insulation that includes a relatively non-polar polymeric material that can be amenable to swelling upon exposure to oil and consider a shield that includes a polymeric material that is not as non-polar as the relatively non-polar polymeric material of the insulation such that the shield may protect the insulation from exposure to oil and where the shield does not swell to an extent that the relatively non-polar polymeric material of the insulation. Such an approach, due to presence of the shield, can allow for use of a swellable material as insulation or as a component of insulation.

As an example, a shield may also act as a gas barrier that hinders permeation of gas to insulation disposed about an electrical conduct. Such an approach can help protect the insulation from gases such as, for example, $CO_2$, $H_2S$ or one or more other types of gases that may be detrimental to the integrity of the insulation.

As an example, a shield may be of a thickness that is less than that of insulation. For example, a layer of insulation material may be about 50 mils (e.g., about 1.27 mm) to about 150 mils (e.g., about 3.8 mm) in thickness and a layer of shield material may be about 10 mils (e.g., about 0.25 mm) to about 25 mils in thickness (e.g., about 0.635 mm). In such examples a thickness may be a radial dimension specified in a cylindrical coordinate system where a longitudinal axis thereof corresponds to a longitudinal axis of an electrical conductor.

As an example, a shield can include a polymeric material that is stronger than a polymeric material that is included in insulation. For example, a shield can include a nitrile rubber that is a synthetic rubber copolymer of acrylonitrile (ACN) and butadiene. As an example, consider one or more types of nitrile butadiene rubber (NBR), which can be one or more types of unsaturated copolymers of 2-propenenitrile and various butadiene monomers (1,2-butadiene and 1,3-butadiene). Physical and chemical properties of a NBR can vary depending on composition of nitrile, which tends to be resistant to oil, fuel, and other chemicals. As an example, a higher nitrile content within a polymer material can correspond to a higher resistance to oil; however, with a lower the flexibility of the polymeric material.

As an example, a nitrile material may be a nitrile rubber such as, for example, NBR, XNBR, HNBR, etc. NBR is at times referred to as "Buna N", which is derived from butadiene and natrium (sodium, a catalyst that may be used in the polymerization of butadiene) while the letter "N" stands for acrylonitrile.

As to NBR, butadiene can impart elasticity and flexibility as well as supply an unsaturated bond for crosslinking, vulcanization, etc. while acrylonitrile (ACN) can impart hardness, tensile strength, and abrasion resistance, as well as resistance to hydrocarbons. As an example, heat resistance may be improved through increased ACN content (e.g., which may be in a range from about 18 percent to about 45 percent). As an example, a reduction in ACN content tends to reduce high temperature properties, increase material swell, and reduce fluid resistance. As an example, to improve high temperature properties, a peroxide cure system and/or fillers may be used. Various nitrile compounds may exhibit suitable tensile strength as well as resistance to abrasion, tear and compression set.

As an example, carboxylated nitrile rubber compounds (XNBR) may be utilized as a shield material. As an example, XNBR may provide strength properties, especially abrasion resistance, when compared to NBR (e.g., without carboxylation). As an example, carboxylated nitriles may be produced by inclusion of carboxylic acid groups (e.g., as polymer groups during polymerization). In such an example, carboxylic acid groups can provide extra crosslinks (e.g., pseudo or ionic crosslinks) and thereby produce harder, tougher compounds with higher abrasion resistance, modulus, and tensile strength than standard nitriles.

As to HNBR, hydrogenated nitrile butadiene rubber, it includes so-called highly saturated hydrocarbons and acrylonitrile (ACN) where, for example, increased saturation is achieved via hydrogenation of unsaturated bonds. As an example, increased saturation can impart (e.g., improve) heat, chemical, and ozone resistance. As an example, ACN content of HNBR can impart toughness, as well as resistance to hydrocarbons. Where unsaturated butadiene segments exist (e.g., less than about 10 percent), such sites may facilitate peroxide curing and/or vulcanization. As an example, a peroxide-cured HNBR may exhibit improved thermal properties without further vulcanization (e.g., as with sulfur-cured nitriles).

As an example, various types of fluoroelastomers may be utilized as a shield material. As an example, consider fluoroelastomers abbreviated as FKMs. FKM (FPM by ISO) is a designation for about 80 percent of fluoroelastomers as defined in ASTM D1418. FKMs may exhibit heat and fluid resistance. For example, in FKMs, bonds between carbon atoms of the polymer backbone and attached (pendant) fluorine atoms tend to be resistant to chain scission and relatively high fluorine-to-hydrogen ratios can provide stability (e.g., reduced risk of reactions or environmental breakdown). Further, FKMs tend to include a carbon backbone that is saturated (e.g., lacking covalent double bonds, which may be attack sites). Elastomers such as one or more of the VITON™ class of FKM elastomers (E. I. du Pont de Nemours & Co., Wilmington, Del.) may be used (e.g., VITON™ A, VITON™ B, VITON™ F, VITON™ GF, VITON™ GLT, VITON™ GFLT, etc.).

As an example, insulation can include a polymeric material such as, for example, EPDM (e.g., where The E refers to ethylene, P to propylene, D to diene and M refers to a classification in ASTM standard D-1418; e.g., ethylene copolymerized with propylene and a diene or ethylene propylene diene monomer (M-class) rubber). EPDM can be a byproduct of petroleum where EPDM and petroleum are largely composed of nonpolar molecules such that they are miscible (e.g., oil can permeate into EPDM and cause it to swell).

As an example, a material may be characterized at least in part by a solubility parameter. For example, consider the Hildebrand solubility parameter (δ), which provides a numerical estimate of the degree of interaction between materials, and can be an indication of solubility, particularly for non-polar materials such as various types of polymeric materials that are relatively non-polar. Materials with similar values of δ are likely to be miscible. The units on the solubility parameter (δ) can be given in (calories per $cm^3)^{0.5}$.

TABLE 1

| Example Solubility Parameters (calories per $cm^3)^{0.5}$ | |
|---|---|
| n-Pentane | 7 |
| n-hexane | 7.24 |
| Diethyl Ether | 7.62 |
| Ethyl Acetate | 9.1 |
| Chloroform | 9.21 |
| Dichloromethane | 9.93 |
| Acetone | 9.77 |
| 2-propanol | 11.6 |
| Ethanol | 12.92 |
| PTFE | 6.2 |
| Poly(ethylene) | 7.9 |
| Poly(propylene) | 8.2 |
| Poly(styrene) | 9.13 |
| Poly(phenylene oxide) | 9.15 |
| PVC | 9.5 |
| PET | 10.1 |
| Nylon 6,6 | 13.7 |
| Poly(methyl methacrylate) | 9.3 |
| (Hydroxyethyl)methacrylate | 25-26 |
| poly(HEMA) | 26.93 |
| Ethylene Glycol | 29.9 |
| FKM (VITON ™) | 13.1 |
| EPDM | 8 |
| NBR/HNBR | 9-11 |

As an example, where the solubility parameter of a fluid and NBR is greater than about 1.5 points, the swelling of the NBR may be expected to be less than about 25 percent when immersed in the fluid.

As an example, nitrile rubber of with about 43 percent acrylonitrile content, for example, has a solubility parameter of about 10.5 and hydrogenated nitrile rubber with about 43 percent acrylonitrile content has a solubility parameter of about 10.7. EPDM can have a solubility parameter of about 8.

As an example, consider a solubility parameter of EPDM being relatively close to that of crude oils at around 8.0. Thus, EPDM can be expected to swell in the presence of crude oils. As an example, the solubility parameter of NBR can be about 9 to about 10.5, which can depend upon nitrile content and which may be higher for HNBR or, for example, a blend of NBR and HNBR. As the solubility parameter of NBR differs from that of crude oil, NBR can be expected to swell considerably less than EPDM when both are exposed to crude oils. As an example, such swelling of NBR can be reduced via addition of one or more types of fillers in NBR (e.g., dispersed particles, etc.) where such one or more types of fillers impart some amount of structural integrity, without themselves being substantially swellable in crude oils.

As an example, a cable can include an electrical conductor with EPDM insulation and a NBR shield disposed about the EPDM insulation where the NBR shield hinders permeation of one or more chemicals to thereby help to protect the EPDM from exposure to such one or more chemicals. In such an example, the NBR shield can impart strength to the cable, when compared to EPDM insulation without the NBR shield.

As an example, a shield can include a polymeric material and a material that alters conductivity of the shield. For example, a clay material may be utilized as a filler that can be dispersed in a polymeric material. Such a material can reduce electrical conductivity of the shield. As an example, consider a surface-treated (e.g., surface modified) kaolin clay. As an example, consider a commercially available kaolin clay marketed as TRANSLINK™ 37 clay, which has an average particle size of about 1.4 microns (BASF, Ludwigshafen, Germany). Such a clay can reinforce a polymeric material and reduce water transmission. Such a clay is suitable for use with peroxide cure systems. As an example, for a semi-conductive shield, a carbon black may be utilized. As an example, consider a commercially available carbon black marketed as VULCAN™ XC72 conductive carbon black (Cabot Corporation, Billerica, Mass.).

As an example, a cable may be utilized as a power cable and deployment cable for a tool. For example, consider a cable that can be utilized to power and to deploy an electric submersible pump (ESP) in a bore in a geologic environment. In such an example, the ESP may be exposed to one or more oils such that a shield disposed about insulation may hinder permeation of one or more of such one or more oils to the insulation. In such an example, the shield may hinder permeation of one or more gases to the insulation. In such an example, the shield may impart strength to the insulation, optionally be chemically bonded to the insulation.

As an example, an ESP power cable can include a primary EPDM insulation core and a co-extruded NBR or HNBR outer skin insulation shield. In some embodiments, the outer skin insulation shield can provide a high strength, fluid and gas resistant barrier while maintaining relatively low cost, dielectric properties and temperature resistance of the EPDM-based insulation. In some embodiments, the outer skin insulation shield can be made semi-conductive to aid in electrical stress distribution for, e.g., applications where power may be carried at a level above about 5 kV. In some embodiments, a primary insulation core and an outer skin insulation shield may be simultaneously formed by a co-extrusion process and chemically crosslinked together. In some embodiments, a primary insulation core and an outer skin insulation may be strippable layers. As an example, such layers may be strippable individually and/or strippable together.

As an example, an insulation and shield arrangement can improve mechanical strength and chemical resistance of a cable, which can be of particular value in high reliability applications or applications where a high temperature cable is expected to contact hydrocarbon fluids.

As an example, a cable may be substantially lead (Pb) free. For example, an NBR shield may be utilized rather than a lead (Pb)-based shield in a cable, which may also result in a decrease in cable weight. While NBR is mentioned, as an example, one or other types of elastomers may be utilized. As an example, where a certain level of $H_2S$ resistance is desired, one or more types of fluoroelastomers (e.g., fluorocarbon-based elastomers, FEPM) may be utilized (e.g., AFLAS™ elastomers, Exton, Pa., etc.). As an example, a shield can include one or more of FFKM elastomers, HNBR, FKM (e.g., VITON™ elastomers, E. I. du Pont de Nemours and Company, Wilmington, Del.) elastomers, and FEPM elastomers (e.g., AFLAS™ elastomers, Exton, Pa.).

As an example, insulation can include polyether ether ketone (PEEK), EPDM and/or another suitable electrically insulating material.

As an example, a cable can include a lead (Pb)-based layer, which may be present as a barrier that can be utilized for electrical stress relief and also as a backup fluid barrier to a shield. As an example, insulation with a shield where the shield is polymer-based, can help to improve dielectric properties and chemical resistance of a leaded (Pb) or non-leaded (Pb) power cables for downhole applications.

FIG. 1 shows examples of geologic environments 120 and 140. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with one or more of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, etc.

As to the geologic environment 140, as shown in FIG. 1, it includes two wells 141 and 143 (e.g., bores), which may be, for example, disposed at least partially in a layer such as a sand layer disposed between caprock and shale. As an example, the geologic environment 140 may be outfitted with equipment 145, which may be, for example, steam assisted gravity drainage (SAGD) equipment for injecting steam for enhancing extraction of a resource from a reservoir. SAGD is a technique that involves subterranean delivery of steam to enhance flow of heavy oil, bitumen, etc. SAGD can be applied for Enhanced Oil Recovery (EOR), which is also known as tertiary recovery because it changes properties of oil in situ.

As an example, a SAGD operation in the geologic environment 140 may use the well 141 for steam-injection and the well 143 for resource production. In such an example, the equipment 145 may be a downhole steam generator and the equipment 147 may be an electric submersible pump (e.g., an ESP). As an example, one or more electrical cables may be connected to the equipment 145 and one or more electrical cables may be connected to the equipment 147. For example, as to the equipment 145, a cable may provide power to a heater to generate steam, to a pump to pump water (e.g., for steam generation), to a pump to pump fuel (e.g., to burn to generate steam), etc. As to the equipment 147, for example, a cable may provide power to power a motor, power a sensor (e.g., a gauge), etc.

As illustrated in a cross-sectional view of FIG. 1, steam injected via the well 141 may rise in a subterranean portion of the geologic environment and transfer heat to a desirable resource such as heavy oil. In turn, as the resource is heated, its viscosity decreases, allowing it to flow more readily to the well 143 (e.g., a resource production well). In such an example, equipment 147 may then assist with lifting the resource in the well 143 to, for example, a surface facility (e.g., via a wellhead, etc.).

As to a downhole steam generator, as an example, it may be fed by three separate streams of natural gas, air and water (e.g., via conduits) where a gas-air mixture is combined first to create a flame and then the water is injected downstream to create steam. In such an example, the water can also serve to cool a burner wall or walls (e.g., by flowing in a passageway or passageways within a wall). As an example, a SAGD operation may result in condensed steam accompanying a resource (e.g., heavy oil) to a well. In such an example, where a production well includes artificial lift equipment such as an ESP, operation of such equipment may be impacted by the presence of condensed steam (e.g., water). Further, as an example, condensed steam may place demands on separation processing where it is desirable to separate one or more components from a hydrocarbon and water mixture.

Each of the geologic environments 120 and 140 of FIG. 1 may include harsh environments therein. For example, a harsh environment may be classified as being a high-pressure and high-temperature environment. A so-called HPHT environment may include pressures up to about 138 MPa (e.g., about 20,000 psi) and temperatures up to about 205 degrees C. (e.g., about 400 degrees F.), a so-called ultra-HPHT environment may include pressures up to about 241 MPa (e.g., about 35,000 psi) and temperatures up to about 260 degrees C. (e.g., about 500 degrees F.) and a so-called HPHT-hc environment may include pressures greater than about 241 MPa (e.g., about 35,000 psi) and temperatures greater than about 260 degrees C. (e.g., about 500 degrees F.). As an example, an environment may be classified based in one of the aforementioned classes based on pressure or temperature alone. As an example, an environment may have its pressure and/or temperature elevated, for example, through use of equipment, techniques, etc. For example, a SAGD operation may elevate temperature of an environment (e.g., by 100 degrees C. or more).

As an example, an environment may be classified based at least in part on its chemical composition. For example, where an environment includes hydrogen sulfide ($H_2S$), carbon dioxide ($CO_2$), etc., the environment may be corrosive to certain materials. As an example, an environment may be classified based at least in part on particulate matter that may be in a fluid (e.g., suspended, entrained, etc.). As an example, particulate matter in an environment may be abrasive or otherwise damaging to equipment. As an example, matter may be soluble or insoluble in an environment and, for example, soluble in one environment and substantially insoluble in another.

Conditions in a geologic environment may be transient and/or persistent. Where equipment is placed within a geologic environment, longevity of the equipment can depend on characteristics of the environment and, for example, duration of use of the equipment as well as function of the equipment. For example, a high-voltage power cable may itself pose challenges regardless of the environment into which it is placed. Where equipment is to endure in an environment over a substantial period of time, uncertainty may arise in one or more factors that could impact integrity or expected lifetime of the equipment. As an example, where a period of time may be of the order of decades, equipment that is intended to last for such a period of time should be constructed with materials that can endure environmental conditions imposed thereon, whether imposed by an environment or environments and/or one or more functions of the equipment itself.

Figure 2:
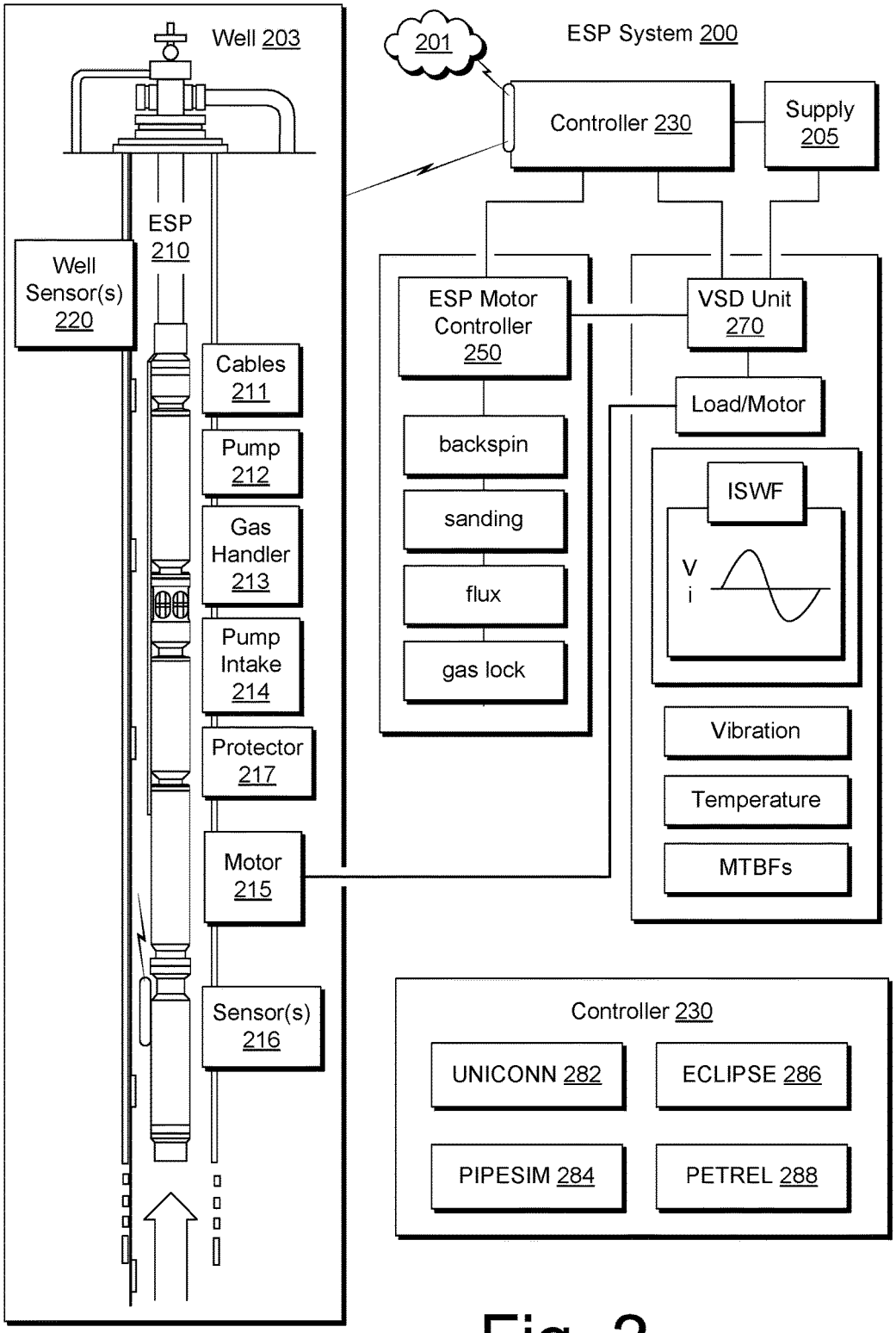
FIG. 2 illustrates an example of an electric submersible pump system.

FIG. 2 shows an example of an ESP system 200 that includes an ESP 210 as an example of equipment that may be placed in a geologic environment. As an example, an ESP may be expected to function in an environment over an extended period of time (e.g., optionally of the order of years). As an example, a commercially available ESP (such as one of the REDA™ ESPs marketed by Schlumberger Limited, Houston, Tex.) may be employed to pump fluid(s).

In the example of FIG. 2, the ESP system 200 includes a network 201, a well 203 disposed in a geologic environment, a power supply 205, the ESP 210, a controller 230, a motor controller 250 and a variable speed drive (VSD) unit 270. The power supply 205 may receive power from a power grid, an onsite generator (e.g., natural gas driven turbine), or other source. The power supply 205 may supply a voltage, for example, of about 4.16 kV or more.

As shown, the well 203 includes a wellhead that can include a choke (e.g., a choke valve). For example, the well 203 can include a choke valve to control various operations such as to reduce pressure of a fluid from high pressure in a closed wellbore to atmospheric pressure. Adjustable choke valves can include valves constructed to resist wear due to high-velocity, solids-laden fluid flowing by restricting or sealing elements. A wellhead may include one or more sensors such as a temperature sensor, a pressure sensor, a solids sensor, etc.

As to the ESP 210, it is shown as including cables 211 (e.g., or a cable), a pump 212, gas handling features 213, a pump intake 214, a motor 215, one or more sensors 216 (e.g., temperature, pressure, current leakage, vibration, etc.) and optionally a protector 217. The well 203 may include one or more well sensors 220. As an example, a fiber-optic based sensor or other type of sensor may provide for real time sensing of temperature, for example, in SAGD or other operations. As shown in the example of FIG. 1, a well can include a relatively horizontal portion. Such a portion may collect heated heavy oil responsive to steam injection. Measurements of temperature along the length of the well can provide for feedback, for example, to understand conditions downhole of an ESP. Well sensors may extend into a well and beyond a position of an ESP.

In the example of FIG. 2, the controller 230 can include one or more interfaces, for example, for receipt, transmission or receipt and transmission of information with the motor controller 250, the VSD unit 270, the power supply 205 (e.g., a gas fueled turbine generator, a power company, etc.), the network 201, equipment in the well 203, equipment in another well, etc.

As shown in FIG. 2, the controller 230 can include or provide access to one or more modules or frameworks. Further, the controller 230 may include features of a motor controller and optionally supplant the motor controller 250. For example, the controller 230 may include the UNICONN™ motor controller 282 marketed by Schlumberger Limited (Houston, Tex.). In the example of FIG. 2, the controller 230 may access one or more of the PIPESIM™framework 284, the ECLIPSE™ framework 286 marketed by Schlumberger Limited (Houston, Tex.) and the PETREL™ framework 288 marketed by Schlumberger Limited (Houston, Tex.) (e.g., and optionally the OCEAN™ framework marketed by Schlumberger Limited (Houston, Tex.)).

In the example of FIG. 2, the motor controller 250 may be a commercially available motor controller such as the UNICONN™ motor controller. As an example, the UNICONN™ motor controller can perform some control and data acquisition tasks for ESPs, surface pumps or other monitored wells. For example, the UNICONN™ motor controller can interface with the PHOENIX™ monitoring system, for example, to access pressure, temperature and vibration data and various protection parameters as well as to provide direct current power to downhole sensors. The UNICONN™ motor controller can interface with fixed speed drive (FSD) controllers or a VSD unit, for example, such as the VSD unit 270.

For FSD controllers, the UNICONN™ motor controller can monitor ESP system three-phase currents, three-phase surface voltage, supply voltage and frequency, ESP spinning frequency and leg ground, power factor and motor load.

For VSD units, the UNICONN™ motor controller can monitor VSD output current, ESP running current, VSD output voltage, supply voltage, VSD input and VSD output power, VSD output frequency, drive loading, motor load, three-phase ESP running current, three-phase VSD input or output voltage, ESP spinning frequency, and leg-ground.

The UNICONN™ motor controller can include control functionality for VSD units such as target speed, minimum and maximum speed and base speed (voltage divided by frequency); three jump frequencies and bandwidths; volts per hertz pattern and start-up boost; ability to start an ESP while the motor is spinning; acceleration and deceleration rates, including start to minimum speed and minimum to target speed to maintain constant pressure/load (e.g., from about 0.01 Hz/10,000 s to about 1 Hz/s); stop mode with PWM carrier frequency; base speed voltage selection; rocking start frequency, cycle and pattern control; stall protection with automatic speed reduction; changing motor rotation direction without stopping; speed force; speed follower mode; frequency control to maintain constant speed, pressure or load; current unbalance; voltage unbalance; overvoltage and undervoltage; ESP backspin; and leg-ground.

In the example of FIG. 2, the motor controller 250 includes various modules to handle, for example, backspin of an ESP, sanding of an ESP, flux of an ESP and gas lock of an ESP. As an example, the motor controller 250 may include one or more of such features, other features, etc.

In the example of FIG. 2, the VSD unit 270 may be a low voltage drive (LVD) unit, a medium voltage drive (MVD) unit or other type of unit (e.g., a high voltage drive, which may provide a voltage in excess of about 4.16 kV). For a LVD, a VSD unit can include a step-up transformer, control circuitry and a step-up transformer while, for a MVD, a VSD unit can include an integrated transformer and control circuitry. As an example, the VSD unit 270 may receive power with a voltage of about 4.16 kV and control a motor as a load with a voltage from about 0 V to about 4.16 kV.

As an example, an ESP cable may be rated at, for example, about 3 kV, about 4 kV, or about 5 kV (e.g., or more) and may have a form factor that is flat or round. As an example, for various subsea operations, an ESP cable may be rated at about 6 kV. As an example, a round form factor cable may be used in an application where there is sufficient room in a bore. A round form factor cable may also allow for cancelling electromagnetic interference and promoting evenness of phases to phase voltage distribution. As an example, a flat form factor cable may be used in low clearance applications within a bore or, for example, in shorter run lengths where an increase in temperature of a center conductor is not an appreciable concern during operation.

The VSD unit 270 may include commercially available control circuitry such as the SPEEDSTAR™ MVD control circuitry marketed by Schlumberger Limited (Houston, Tex.). The SPEEDSTAR™ MVD control circuitry is suitable for indoor or outdoor use and comes standard with a visible fused disconnect switch, precharge circuitry, and sine wave output filter (e.g., integral sine wave filter, ISWF) tailored for control and protection of high-horsepower ESPs. The SPEEDSTAR™ MVD control circuitry can include a plug-and-play sine wave output filter, a multilevel PWM inverter output, a 0.95 power factor, programmable load reduction (e.g., soft-stall function), speed control circuitry to maintain constant load or pressure, rocking start (e.g., for stuck pumps resulting from scale, sand, etc.), a utility power receptacle, an acquisition system for the PHOENIX™ monitoring system, a site communication box to support surveillance and control service, a speed control potentiometer. The SPEEDSTAR™ MVD control circuitry can optionally interface with the UNICONN™ motor controller, which may provide some of the foregoing functionality.

In the example of FIG. 2, the VSD unit 270 is shown along with a plot of a sine wave (e.g., achieved via a sine wave filter that includes a capacitor and a reactor), responsiveness to vibration, responsiveness to temperature and as being managed to reduce mean time between failures (MTBFs). The VSD unit 270 may be rated with an ESP to provide for about 40,000 hours (5 years) of operation (e.g., depending on environment, load, etc.). The VSD unit 270 may include surge and lightening protection (e.g., one protection circuit per phase). As to leg-ground monitoring or water intrusion monitoring, such types of monitoring may indicate whether corrosion is or has occurred. Further monitoring of power quality from a supply, to a motor, at a motor, may occur by one or more circuits or features of a controller.

While the example of FIG. 2 shows an ESP that may include centrifugal pump stages, another type of ESP may be controlled. For example, an ESP may include a hydraulic diaphragm electric submersible pump (HDESP), which is a positive-displacement, double-acting diaphragm pump with a downhole motor. HDESPs find use in low-liquid-rate coalbed methane and other oil and gas shallow wells that benefit from artificial lift to remove water from the wellbore. HDESPs may handle a wide variety of fluids and, for example, up to about 2% sand, coal, fines and $H_2S/CO_2$.

As an example, an ESP may include a REDA™ HOTLINE™ high-temperature ESP motor. Such a motor may be suitable for implementation in various types of environments. As an example, a REDA™ HOTLINE™ high-temperature ESP motor may be implemented in a thermal recovery heavy oil production system, such as, for example, SAGD system or other steam-flooding system.

As an example, an ESP motor can include a three-phase squirrel cage with two-pole induction. As an example, an ESP motor may include steel stator laminations that can help focus magnetic forces on rotors, for example, to help reduce energy loss. As an example, stator windings can include copper and insulation. As an example, a motor may be a multiphase motor. As an example, a motor may include windings, etc., for three or more phases.

For connection to a power cable or motor lead extensions (MLEs), a motor may include a pothead. Such a pothead may, for example, provide for a tape-in connection with metal-to-metal seals and/or metal-to-elastomer seals (e.g., to provide a barrier against fluid entry). A motor may include one or more types of potheads or connection mechanisms. As an example, a pothead unit may be provided as a separate unit configured for connection, directly or indirectly, to a motor housing.

As an example, a motor may include dielectric oil (e.g., or dielectric oils), for example, that may help lubricate one or more bearings that support a shaft rotatable by the motor. A motor may be configured to include an oil reservoir, for example, in a base portion of a motor housing, which may allow oil to expand and contract with wide thermal cycles. As an example, a motor may include an oil filter to filter debris.

As an example, a motor housing can house stacked laminations with electrical windings extending through slots in the stacked laminations. The electrical windings may be formed from magnet wire that includes an electrical conductor and at least one polymeric dielectric insulator surrounding the electrical conductor. As an example, a polymeric insulation layer may include a single layer or multiple layers of dielectric tape that may be helically wrapped around an electrical conductor and that may be bonded to the electrical conductor (e.g., and to itself) through use of an adhesive. As an example, a motor housing may include slot liners. For example, consider a material that can be positioned between windings and laminations.

Figure 3:
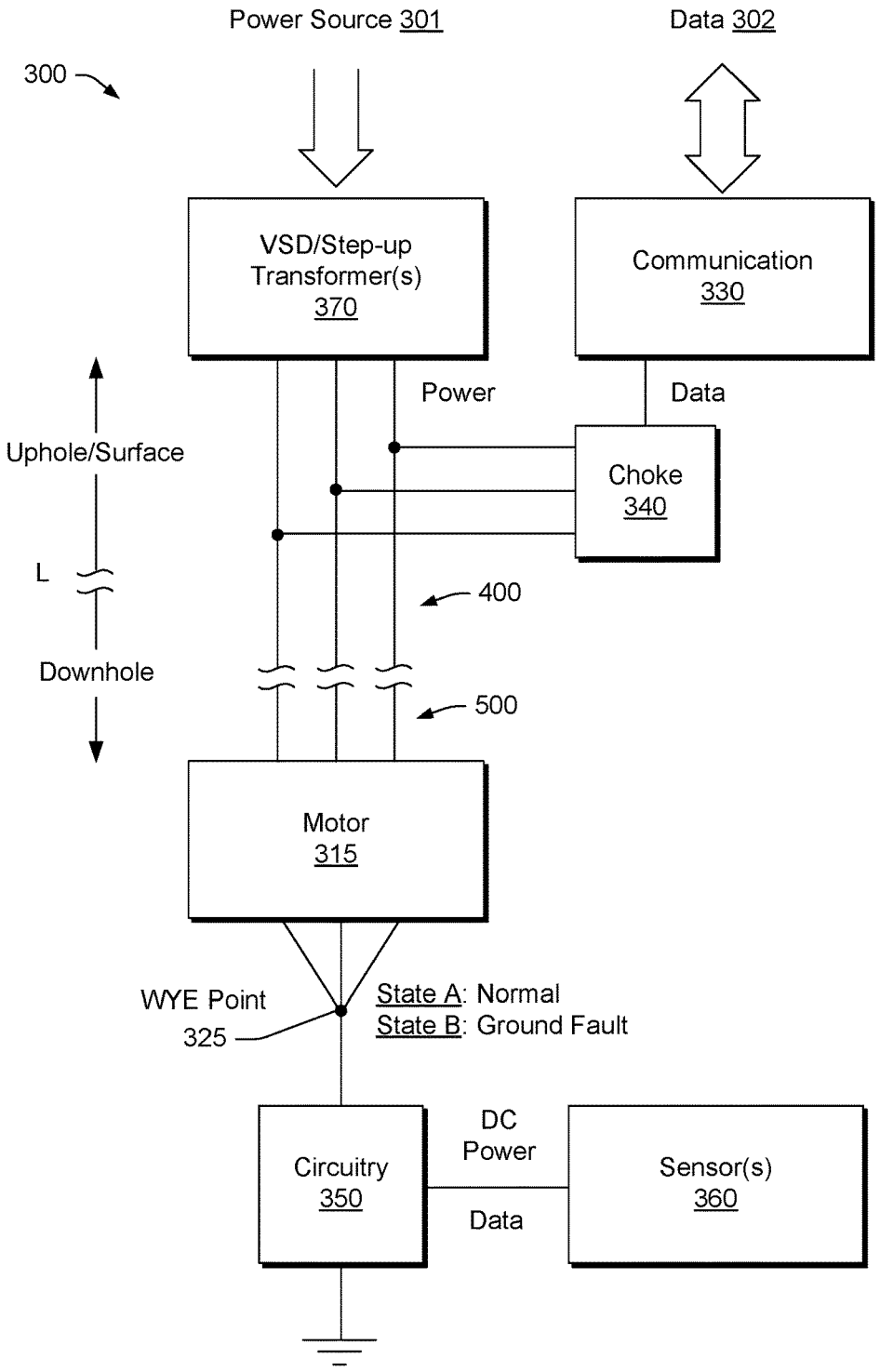
FIG. 3 illustrates examples of equipment.

FIG. 3 shows a block diagram of an example of a system 300 that includes a power cable 400 and MLEs 500. As shown, the system 300 includes a power source 301 as well as data 302. In the example of FIG. 3, the power source 301 can provide power to a VSD/step-up transformer block 370 while the data 302 may be provided to a communication block 330. The data 302 may include instructions, for example, to instruct circuitry of the circuitry block 350, one or more sensors of the sensor block 360, etc. The data 302 may be or include data communicated, for example, from the circuitry block 350, the sensor block 360, etc. In the example of FIG. 3, a choke block 340 can provide for transmission of data signals via the power cable 400 and the MLEs 500.

As shown, the MLEs 500 connect to a motor block 315, which may be a motor (or motors) of a pump (e.g., an ESP, etc.) and be controllable via the VSD/step-up transformer block 370. In the example of FIG. 3, the conductors of the MLEs 500 electrically connect at a WYE point 325. The circuitry block 350 may derive power via the WYE point 325 and may optionally transmit, receive or transmit and receive data via the WYE point 325. As shown, the circuitry block 350 may be grounded.

The system 300 can operate in a normal state (State A) and in a ground fault state (State B). One or more ground faults may occur for one or more of a variety of reasons. For example, wear of the power cable 400 may cause a ground fault for one or more of its conductors. As another example, wear of one of the MLEs may cause a ground fault for its conductor. As an example, gas intrusion, fluid intrusion, etc. may degrade material(s), which may possibly lead a ground fault.

The system 300 may include provisions to continue operation of a motor of the motor block 315 when a ground fault occurs. However, when a ground fault does occur, power at the WYE point 325 may be altered. For example, where DC power is provided at the WYE point 325 (e.g., injected via the choke block 340), when a ground fault occurs, current at the WYE point 325 may be unbalanced and alternating. The circuitry block 350 may or may not be capable of deriving power from an unbalanced WYE point and, further, may or may not be capable of data transmission via an unbalanced WYE point.

The foregoing examples, referring to "normal" and "ground fault" states, demonstrate how ground faults can give rise to various issues. Power cables and MLEs that can resist damaging forces, whether mechanical, electrical or chemical, can help ensure proper operation of a motor, circuitry, sensors, etc. Noting that a faulty power cable (or MLE) can potentially damage a motor, circuitry, sensors, etc. Further, as mentioned, an ESP may be located several kilometers into a wellbore. Accordingly, the time and cost to replace a faulty ESP, power cable, MLE, etc., can be substantial.

Figure 4:
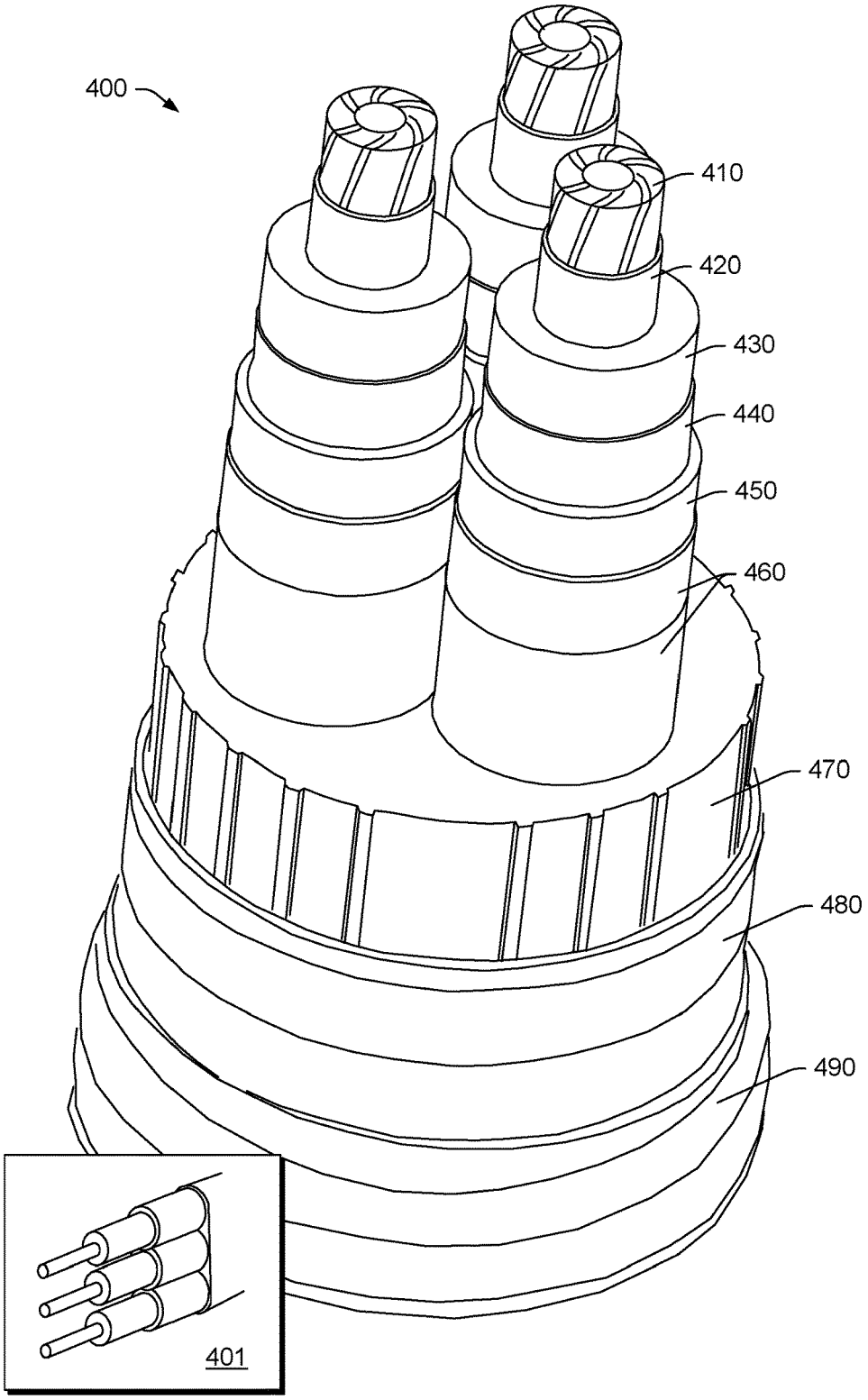
FIG. 4 illustrates examples of cables.

FIG. 4 shows an example of the power cable 400, suitable for use in the system 300 of FIG. 3 or optionally one or more other systems (e.g., SAGD, etc.). In the example of FIG. 4, the power cable 400 includes three conductor assemblies where each assembly includes a conductor 410, a conductor shield 420, insulation 430, an insulation shield 440, a metallic shield 450, and one or more barrier layers 460. The three conductor assemblies are seated in a cable jacket 470, which is surrounded by a first layer of armor 480 and a second layer of armor 490. As to the cable jacket 470, it may be round or as shown in an alternative example 401, rectangular (e.g., "flat").

As an example, a power cable may include, for example, conductors that are made of copper (see, e.g., the conductors 410); an optional conductor shield for each conductor (see, e.g., the conductor shield 420), which may be provided for voltage ratings in excess of about 5 kV; insulation such as high density polyethylene (HDPE), polypropylene or EPDM (e.g., where The E refers to ethylene, P to propylene, D to diene and M refers to a classification in ASTM standard D-1418; e.g., ethylene copolymerized with propylene and a diene or ethylene propylene diene monomer (M-class) rubber) dependent on temperature rating (see, e.g., the insulation 430); an insulation shield (see, e.g., the insulation shield 440), which may be provided for voltage ratings in excess of about 5 kV, where the insulation shield includes a polymeric material such as, for example, a nitrile rubber type of polymeric material (e.g., NBR, HNBR, etc.); an optional metallic shield that may include metallic lead (Pb) (see, e.g., the metallic shield 450); a barrier layer that may include fluoropolymer (see, e.g., the barrier layer(s) 460); a jacket that may include oil resistant EPDM or nitrile rubber (see, e.g., the cable jacket 470); and one or more layers of armor that may include galvanized, stainless steel, MONEL™ alloy (marketed by Inco Alloys International, Inc., Huntington, W. Va.), etc. (see, e.g., the armor 480 and the armor 490).

As an example, the insulation shield 440 may be considered a barrier layer, for example, which may be formed of a continuous polymeric sheath as extruded about the insulation 430.

As an example, the metallic shield 450 may be considered a barrier layer, for example, which may be formed of a continuous metallic lead (Pb) sheath as extruded about the insulation 430 and/or the insulation shield 440, if present.

In some commercially available REDAMAX™ cables, polytetrafluoroethylene (PTFE) tape is used to form a barrier layer to block fluid and gas entry. For REDALEAD™ cables, metallic lead (Pb) is extruded directly on top of the insulation (see, e.g., the insulation 430 and/or the insulation shield 440) to help prevent diffusion of gas into the insulation (e.g., one or more corrosive gases). The high barrier properties and malleability of metallic lead (Pb) tend to make it a suitable candidate for downhole cable components.

In the example of FIG. 4, as to the conductor 410, it may be solid or compacted stranded high purity copper and coated with a metal or alloy (e.g., tin, lead, nickel, silver or other metal or alloy). As to the conductor shield 420, it may optionally be a semiconductive material with a resistivity less than about 5000 ohm-m and be adhered to the conductor 410 in a manner that acts to reduce voids therebetween (e.g., consider a substantially voidless adhesion interface). As an example, the conductor shield 420 may be provided as an extruded polymer that penetrates into spaces between strands of the stranded conductor 410. As to extrusion of the conductor shield 420, it may optionally be co-extruded or tandem extruded with the insulation 430 (e.g., which may be EPDM or another type of insulation). As an option, nanoscale fillers may be included for low resistivity and suitable mechanical properties (e.g., for high temperature thermoplastics).

As to the Insulation 430, it may be bonded to the conductor shield 420. As an example, the insulation 430 may include polyether ether ketone (PEEK), EPDM and/or another suitable electrically insulating material.

As to the insulation shield 440, it may optionally be a semiconductive material having a resistivity less than about 5000 ohm-m. The insulation shield 440 may be adhered to the insulation 430, but, for example, removable for splicing (e.g., together with the insulation 430), without leaving a substantial amount of residue. As an example, the insulation shield 440 may be extruded polymer, for example, co-extruded with the insulation 430.

As an example, the insulation shield 440 can include one or more materials dispersed in a polymeric material where such one or more materials alter the conductivity of the insulation shield 440.

As to the metallic shield 450 and the barrier layer(s) 460, one or more layers of material may be provided. One or more layers may be provided, for example, to create an impermeable gas barrier. As an example, the cable 400 may include PTFE fluoropolymer, for example, as tape that may be helically taped.

As to the cable jacket 470, it may be round or as shown in the example 401, rectangular (e.g., "flat"). As to material of construction, a cable jacket may include one or more layers of EPDM, nitrile, hydrogenated nitrile butadiene rubber (HNBR), fluoropolymer, chloroprene, or other material (e.g., to provide for resistance to a downhole and/or other environment). As an example, each conductor assembly phase may include solid metallic tubing, such that splitting out the phases is more easily accomplished (e.g., to terminate at a connector, to provide improved cooling, etc.).

As to the cable armor 480 and 490, metal or metal alloy may be employed, optionally in multiple layers for improved damage resistance.

Figure 5:
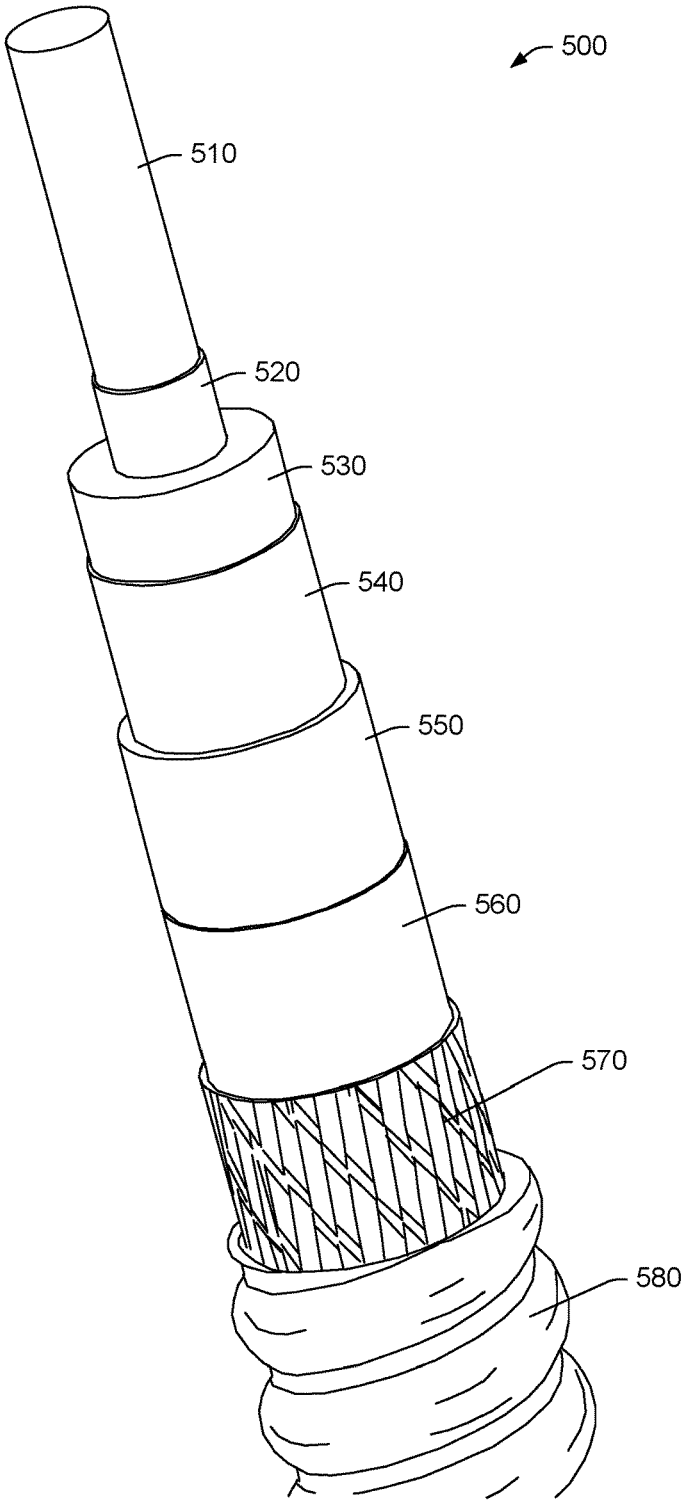
FIG. 5 illustrates an example of a motor lead extension.

FIG. 5 shows an example of one of the MLEs 500 suitable for use in the system 300 of FIG. 3 or optionally one or more other systems (e.g., SAGD, etc.). In the example of FIG. 5, the MLE 500 (or "lead extension") a conductor 510, a conductor shield 520, insulation 530, an insulation shield 540, an optional metallic shield 550, one or more barrier layers 560, a braid layer 570 and armor 580. While the example of FIG. 5 mentions MLE or "lead extension", it may be implemented as a single conductor assembly cable for one or more of a variety of downhole uses.

As to a braid or a braided layer, various types of materials may be used such as, for example, polyethylene terephthalate (PET) (e.g., applied as a protective braid, tape, fabric wrap, etc.). PET may be considered as a low cost and high strength material. As an example, a braid layer can help provide protection to a soft lead jacket during an armor wrapping process. In such an example, once downhole, the function of the braid may be minimal. As to other examples, nylon or glass fiber tapes and braids may be implemented. Yet other examples can include fabrics, rubberized tapes, adhesive tapes, and thin extruded films.

As an example, a conductor (e.g., solid or stranded) may be surrounded by a semiconductive material layer that acts as a conductor shield where, for example, the layer has a thickness greater than approximately 0.005 inch (e.g., approximately 0.127 mm). As an example, a cable can include a conductor with a conductor shield that has a radial thickness of approximately 0.010 inch (e.g., approximately 0.254 mm). As an example, a cable can include a conductor with a conductor shield that has a radial thickness in a range from greater than approximately 0.005 inch to approximately 0.015 inch (e.g., approximately 0.127 mm to approximately 0.38 mm).

As an example, a conductor may have a conductor size in a range from approximately #8 AWG (e.g., OD approx. 0.128 inch or area of approx. 8.36 $mm^2$) to approximately #2/0 "00" AWG (e.g., OD approx. 0.365 inch or area of approx. 33.6 $mm^2$). As examples, a conductor configuration may be solid or stranded (e.g., including compact stranded). As an example, a conductor may be smaller than #8 AWG or larger than #2/0 "00" AWG (e.g., #3/0 "000" AWG, OD approx. 0.41 inch or area of approx. 85 $mm^2$).

As an example, a cable may include a conductor that has a size within a range of approximately 0.1285 inch to approximately 0.414 inch (e.g., approximately 3.26 mm to approximately 10.5 mm) and a conductor shield layer that has a radial thickness within a range of approximately greater than 0.005 inch to approximately 0.015 inch (e.g., approximately 0.127 mm to approximately 0.38 mm).

Figure 6:
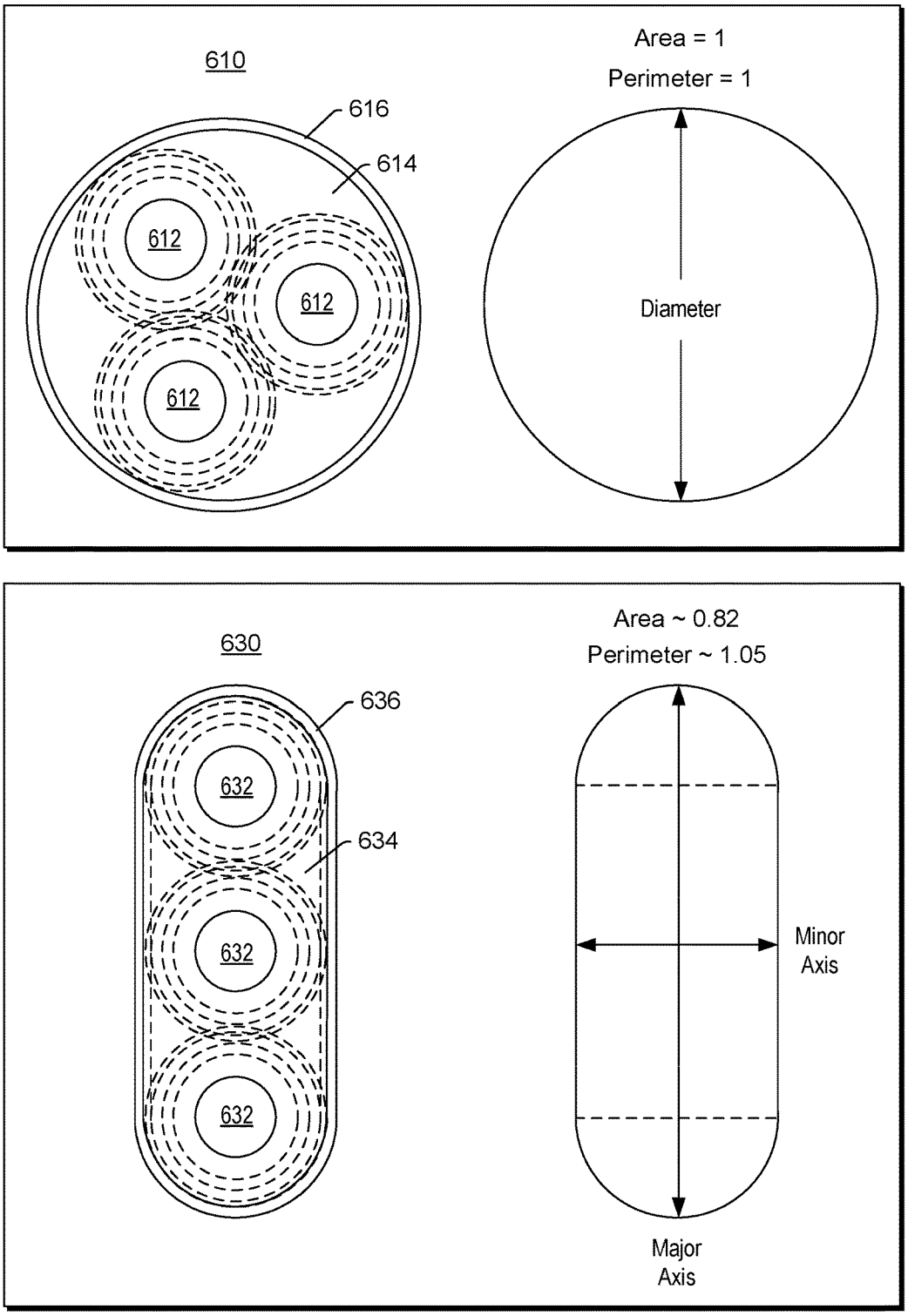
FIG. 6 illustrates examples of arrangements.

FIG. 6 shows an example of a geometric arrangement of components of a round cable 610 and an example of a geometric arrangement of components of an oblong cable 630. As shown the cable 610 includes three conductors 612, a polymeric layer 614 and an outer layer 616 and the oblong cable 630 includes three conductors 632, a polymeric layer 634 (e.g., optionally a composite material with desirable heat transfer properties) and an optional outer polymeric layer 636 (e.g., outer polymeric coat, which may be a composite material). In the examples of FIG. 6, a conductor may be surrounded by one or more optional layers, as generally illustrated via dashed lines. For example, as to the cable 630, consider three 1 gauge conductors (e.g., a diameter of about 7.35 mm) with various layers. In such an example, the polymeric layer 634 may encapsulate the three 1 gauge conductors and their respective layers where, at ends, the polymeric layer 634 may be about 1 mm thick. In such an example, an optional armor layer may be of a thickness of about 0.5 mm. In such an example, the optional outer polymeric layer 636 (e.g., as covering armor) may be of a thickness of about 1 mm (e.g., a 1 mm layer).

As shown in FIG. 6, the cable 610 includes a circular cross-sectional shape while the cable 630 includes an oblong cross-sectional shape. In the example of FIG. 6, the cable 610 with the circular cross-sectional shape has an area of unity and the cable 630 with the oblong cross-sectional shape has area of about 0.82. As to perimeter, where the cable 610 has a perimeter of unity, the cable 630 has a perimeter of about 1.05. Thus, the cable 630 has a smaller volume and a larger surface area when compared to the cable 610. A smaller volume can provide for a smaller mass and, for example, less tensile stress on a cable that may be deployed a distance in a downhole environment (e.g., due to mass of the cable itself).

In the cable 630, the conductors 632 may be about 7.35 mm (e.g., about 1 AWG) in diameter with insulation of about 2 mm thickness, metallic lead (Pb) of about 1 mm thickness, a jacket layer (e.g., the layer 634) over the lead (Pb) of about 1 mm thickness at ends of the cable 630, optional armor of about 0.5 mm thickness and an optional polymeric layer of about 1 mm thickness (e.g., the layer 636 as an outer polymeric coat). As an example, armor can include a strap thickness, which may be singly or multiply applied (e.g., double, triple, etc.). As an example, the cable 630 may be of a width of about 20 mm (e.g., about 0.8 inches) and a length of about 50 mm (e.g., about 2 inches), for example, about a 2.5 to 1 width to length ratio).

As an example, a cable may be formed with phases split out from each other where each phase is encased in solid metallic tubing.

As an example, a cable can include multiple conductors where each conductor can carry current of a phase of a multiphase power supply for a multiphase electric motor. In such an example, a conductor may be in a range from about 8 AWG (about 3.7 mm) to about 00 AWG (about 9.3 mm).

TABLE 2

Examples of Components.

| Cable Component | Dimensions |
|---|---|
| Conductor (Cu) | 8 AWG to 00 AWG (3.7 mm to 9.3 mm) |
| Insulation | 58 mils to 130 mils (1.5 mm to 3.3 mm) |
| Shield | 10 mils to 25 mils (0.25 to 0.635 mm) |
| Metallic Shield (e.g., optional) | 20 mils to 60 mils (0.5 mm to 1.5 mm) |
| Jacket (e.g., optional) | 20 mils to 85 mils (0.5 mm to 2.2 mm) |
| Armor (e.g., optional) | 10 mils to 120 mils (0.25 mm to 3 mm) |
| Polymeric Coat (e.g., optional) | 20 mils to 60 mils (0.5 mm to 1.5 mm) |

As an example, a cable may include conductors for delivery of power to a multiphase electric motor with a voltage range of about 3 kV to about 8 kV. As an example, a cable may carry power, at times, for example, with amperage of up to about 200 A or more.

As to operational conditions, where an electric motor operates a pump, locking of the pump can cause current to increase and, where fluid flow past a cable may decrease, heat may build rapidly within the cable. As an example, locking may occur due to gas in one or more pump stages, bearing issues, particulate matter, etc.

As an example, a cable may carry current to power a multiphase electric motor or other piece of equipment (e.g., downhole equipment powerable by a cable).

As an example, in some flat power cable embodiments, two or more individual coated conductors can be arranged in a side-by-side configuration (e.g., consider configurations such as 2×1, 3×1, 4×1, etc.) and, for example, one or more armor layers can be applied over a jacket.

As an example, a conductor shield layer can be a semi-conductive layer disposed around a conductor that helps to control electrical stress in a cable. The conductor shield layer may be bonded to the conductor and/or to the insulation layer to prevent gas migration. In some embodiments, the conductor shield layer is strippable from the conductor to facilitate access to the underlying conductor. In some embodiments, the conductor shield layer may include a semi-conductive tape wrapped about the conductor. In other embodiments, the conductor shield layer may include an extruded semi-conductive polymer layer disposed over the conductor. In some embodiments, the conductor shield layer may be an elastomer or thermoplastic co-extruded with the insulation thereby allowing the layers to crosslink together and reducing the possibility of voids at the interface. In some embodiments, the material used for the conductor shield is semi-conductive (e.g., having a resistivity of less than 5000 ohm-cm). In some embodiments, the conductor shield is formed from an elastomeric compound, for example, an EPDM-based compound loaded with conductive or semi-conductive fillers. In some embodiments for use in high temperature environments, a PEEK-based (or related high temperature polymer-based) compound containing conductive or semiconductive fillers may be used to form the conductor shield. In some embodiments, the conductor shield and insulation layer use a common base material while in other embodiments these layers use different base materials.

As an example, an insulation layer can be formed around a conductor and an optional, conductor shield layer. In some embodiments, the insulation layer may be formed from an EPDM-based material. In other embodiments, the insulation may be formed from a polyaryletherketone (PAEK) family polymer-based material. For example, the insulation material may include polyetheretherketone (PEEK). The insulation layer may include one or more compounds lending oil resistance and/or decompression resistance to the insulation layer. In some embodiments, the insulation layer is substantially bonded to at least one of the conductor and/or conductor shield layer. In some embodiments, the insulation is continuous with the insulation shield. In some embodiments, the insulation layer is completely bonded to the insulation shield.

As an example, EPDM may be included as a primary insulation material. EPDM tends to exhibit acceptable dielectric properties and heat resistance, but can be susceptible to swell from hydrocarbons. In various environments, hydrocarbon fluids and/or gases may permeate outer layers of a cable and contact the insulation. As an example, insulation may be formulated to reduce swell (e.g., a low-swell EPDM or an oil resistant EPDM). Where a cable is exposed to high pressure gases, gases such as hydrogen sulfide ($H_2S$) can be problematic due to an ability to corrode materials. Where a downhole gas has permeated a cable, a change in external pressure may cause explosive decompression damage, rendering a cable inoperable.

As an example, an insulation shield layer can optionally be a semi-conductive layer applied over an insulation layer to minimize electrical stresses in a cable. In some embodiments, the insulation shield layer is formed from a hydrogenated nitrile butadiene rubber (HNBR). In some embodiments, the insulation shield layer is formed from a FEPM polymer, such as AFLAS® 100S polymer. In some embodiments, an insulation shield layer can be formed from a FKM polymer. In some embodiments, an insulation shield layer is extruded over an insulation layer. For example, in embodiments that include an HNBR insulation shield layer extruded over an EPDM insulation layer, the insulation shield layer may impart enhanced damage resistance in addition to improved resistance to well fluids and gases to the cable.

In some embodiments, an insulation shield layer may be substantially bonded to an insulation layer (e.g., via cross-linking, etc.). In other embodiments, an insulation shield layer may be adhered to an insulation layer using an appropriate adhesive or adhesives based on one or more of the respective materials of the insulation layer and insulation shield layer. In some embodiments, an insulation shield may be strippable (e.g., to allow for termination and electrical testing of the cable). As an example, insulation and shield may be strippable as a unit, for example, where substantially cross-linked at an interface between the insulation and the shield.

In some embodiments, an insulation shield layer may be made conductive through the addition of one or more conductive or semi-conductive fillers. For example, a semi-conductive HNBR insulation shield layer may be used in some embodiments.

In some embodiments, an insulation shield layer can be applied via extrusion. For some embodiments, an insulation shield layer may be co-extruded with an insulation layer. In other embodiments, an insulation shield layer may be tandem extruded with an insulation layer. In yet other embodiments, an insulation layer may be extruded in a first extrusion process and an insulation shield layer applied as a partially completed cable is re-run back through the extruder, such as in a two-pass extrusion method.

In some embodiments, one or more compatibilizers may be used to help ensure that cross-linking occurs at an interface between an insulation layer (e.g., constructed from EPDM, etc.) and an insulation shield layer (e.g., constructed from HNBR, etc.). In some embodiments, an insulation layer and insulation shield layer can be co-extruded via pressure extrusion and cured using compatible cure systems with substantially similar cure rates.

As an example, for an adhered, yet strippable system, the degree of adhesion may be controlled. For example, consider control via one or more of compound additives and one or more process controls. In some embodiments, a multi-stage extrusion approach (e.g., tandem or multi-step) may offer sufficient control to achieve a desired amount of full cross-linking between the layers.

As an example, oxidation may be fostered of a layer via passage of the layer through a hot oven in a gas environment that includes oxygen (e.g., air, enriched air, etc.). In such an example, the oxidation can reduce a number of available groups that may participate in chemical bonding with a subsequently applied layer. For example, consider passing EPDM through a hot oven to oxidize a number of sites (e.g., according to a site density) to thereby control an amount of cross-linking to a subsequently applied layer, which can be, for example, a shield.

As an example, a chemical or chemicals may be applied to a layer to control an amount of cross-linking. As an example, a water-based silicone material may be applied (e.g., as a mist, etc.) to a surface of an insulation layer whereby the water-based silicone material acts to reduce cross-linking of a subsequently applied layer, which can be, for example, a shield. As an example, a silicon oil, a hydrocarbon oil and/or another type of oil may optionally be applied to insulation where the oil or oils can act as release agents for a material deposited thereon (e.g., for release of one layer from an underlying insulation layer, etc.). As an example, an oil or other release agent may be applied via misting, wiping, dripping, etc. on to insulation prior to deposition of another layer.

In some embodiments, an insulation shield layer may include a filler material. In some embodiments, an insulation shield layer may include a high aspect ratio filler such as, for example, a graphene nanoplatelet (GnP) filler.

As an example, graphene nanoplatelets can include, for example, commercially available nanoplatelets (e.g., consider xGnP™ material as marketed by XG Sciences, Lansing, Mich., etc.).

As an example, a filler may be a material that has a substantially two-dimensional character. For example, various types of nanoplatelets may be considered to be substantially two-dimensional in character where thickness of the nanoplatelets is smaller than planar, plate dimensions. For example, consider thickness (e.g., a z dimension) that is two orders of magnitude less than a plate dimension (e.g., x or y dimensions). As an example, a two-dimensional character filler can be utilized to as a filler that can hinder transport of gas through a polymeric material (e.g., a polymeric matrix) that includes the filler dispersed therein. As an example, such a filler may be included in a HNBR matrix to create a modified HNBR composite material that is rated as "low permeation" with respect to one or more gases.

As an example, particle size of graphene nanoplatelets can be characterized by a diameter as a dimension (e.g., an effective diameter), which may be, for example, in a range of about 1 micron to about 25 microns, and include surface characteristics in a range of about 20 $m^2/g$ to about 750 $m^2/g$. In such examples, a nanoplatelet may be characterized in a thickness or depth dimension. For example, consider nanoplatelets with an average thickness of approximately 2 nanometers.

As an example, a shield can include particles with an approximate surface area of about 120 $m^2/g$ to about 150 $m^2/g$ and available average particle diameters of approximately 5 microns, approximately 15 microns and approximately 25 microns.

As an example, a shield can include particles with an approximate surface area of about 60 $m^2/g$ to about 80 $m^2/g$ and available average particle diameters of approximately 5 microns, approximately 15 microns and approximately 25 microns.

As an example, one or more types of GnP fillers may be incorporated into an insulation shield material via mixing, for example, via a high shear internal mixer. As an example, such a composite material may then be extruded, for example, via a high pressure extruder.

As an example, a GnP filler may tend to orient particles along an extrusion direction during processing and may form a tortuous path for gases to permeate through thereby reducing the gas permeability of an insulation shield layer.

As an example, a metallic shield layer may be applied over an insulation shield layer. In such an example, the metallic shield layer may serve as a ground plane. In some embodiments, a metallic shield layer may serve to electrically isolate the phases of the cable from each other. As an example, a metallic shield layer may be formed from a number of metallic materials including, but not limited to: copper, aluminum, lead, and alloys thereof. In some embodiments, a metallic shield layer may be formed as a conductive material tape, braid, paint, or extrusion layer.

As an example, a barrier layer can be a layer exterior to a shield (e.g., an insulation shield layer) that may aim to provide additional protection from corrosive downhole gases and fluids. In some embodiments, a barrier layer may be formed as an extruded layer while in other embodiments a barrier layer may be formed as a taped layer. In some embodiments, a barrier layer may be formed from one or more fluoropolymers, lead, or another material resistant to downhole gases and fluids. In some embodiments, a combination of extruded and taped layers may be used to form the barrier layer.

As an example, a cable jacket may offer fluid-, gas-, and/or temperature-resistance to a cable. In some embodiments, a jacket may be constructed from one or more layers of one or more materials (e.g., consider one or more of EPDM, nitrile rubber, HNBR, fluoropolymers, chloroprene, or another material offering suitable resistance to downhole conditions).

In some embodiments, a cable may use EPDM and/or nitrile based elastomer compounds in a jacketing layer. In some embodiments, one or more jacket layer compounds may be oil and/or water and/or brine and/or thermal and/or decompression resistant.

As an example, cable armor may be constructed from one or more of a variety of materials including, but not limited to, one or more of galvanized steel, stainless steel, MONEL™ alloy, or another metal, metal alloy, or non-metal resistant to downhole conditions. In some embodiments, cable armor can encase a plurality of wrapped conductors. In other embodiments, each wrapped conductor may be individually encased in its own cable armor.

As an example, a method can include covulcanization of two different polymeric materials. For example, EPDM and HNBR may be covulcanized, optionally at or proximate to an interface where a gradation may occur in composition from EPDM to HNBR, etc. (e.g., from a smaller radius to a larger radius). As an example, an extruder may allow for some amount of mixing of two molten materials that can be co-extruded. For example, consider a zone of a first material, a zone of mixed first and second materials and a zone of the second material.

As an example, a method can include covulcanization in the presence of a hydrogenated carboxylated nitrile rubber (e.g., an HXNBR), a multivalent salt of an organic acid and a vulcanizing agent. As an example, a HXNBR may be a commercially available THERBAN™ XT material (Lanxess Deutschland GMBH, Leverkusen, Germany). As to a vulcanizing agent, a peroxide agent may be utilized. As an example, a salt can be a metal salt where an organic acid may be up to about 8 carbon atoms (e.g., acrylic acid, methacrylic acid, etc.). As an example, consider zinc diacrylate or zinc dimethacrylate. As an example, consider an extrusion process that can include injecting one or more materials for covulcanization in a mixture of a first polymeric material and a second polymeric material.

As to EPDM as an insulation material and HNBR as a shield material. Various trials demonstrated properties of such materials, particularly with respect to conditions that may be experienced in an environment such as downhole environment.

Figure 7:
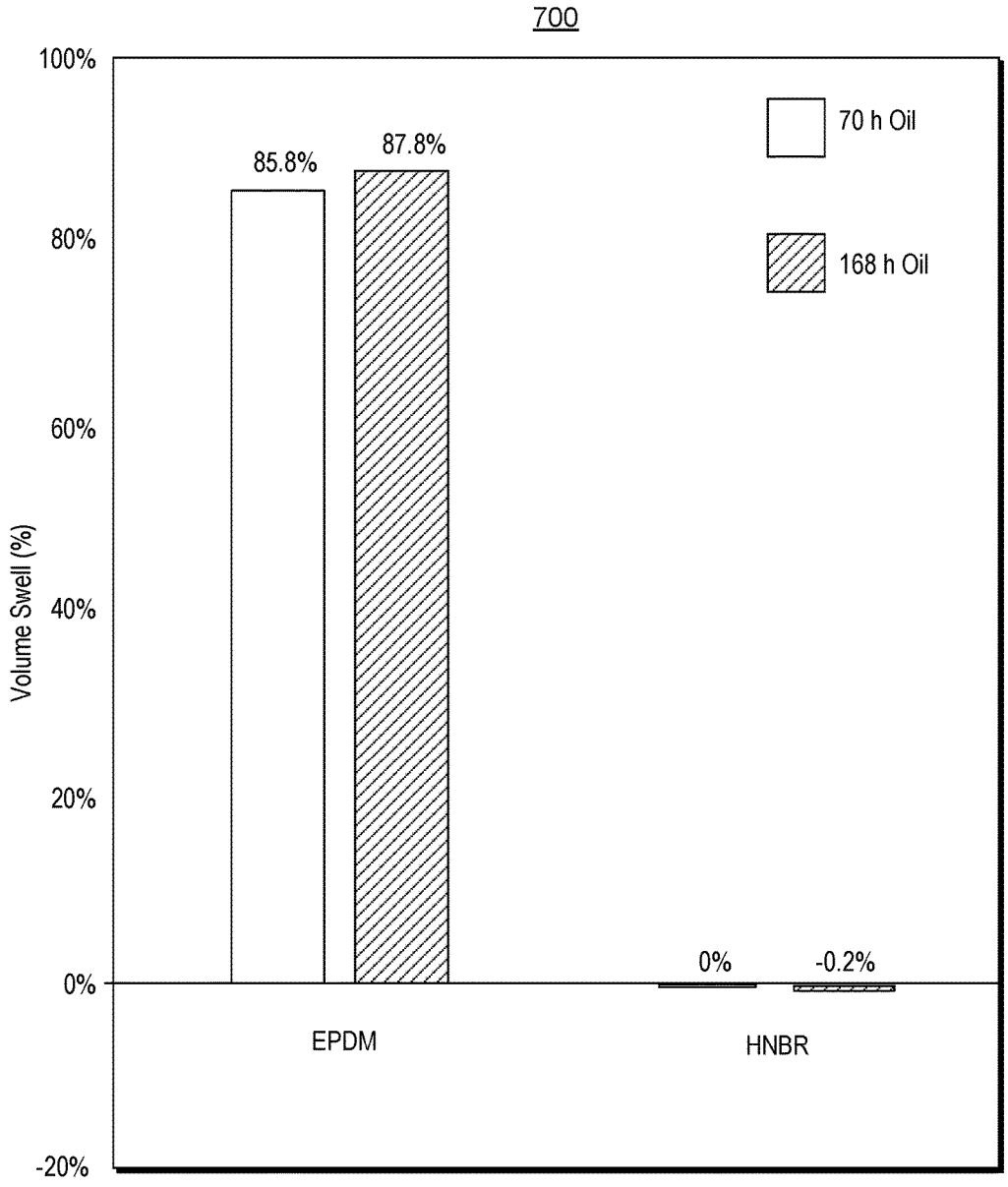
FIG. 7 illustrates an example of a plot.

FIG. 7 shows an example plot 700 of data pertaining to volume swell with aging of a HNBR material and an EPDM material at 70 hours and at 168 hours in oil at about 177 degrees C. As shown in FIG. 7, the HNBR material demonstrates negligible swell compared the EPDM material.

Figure 8:
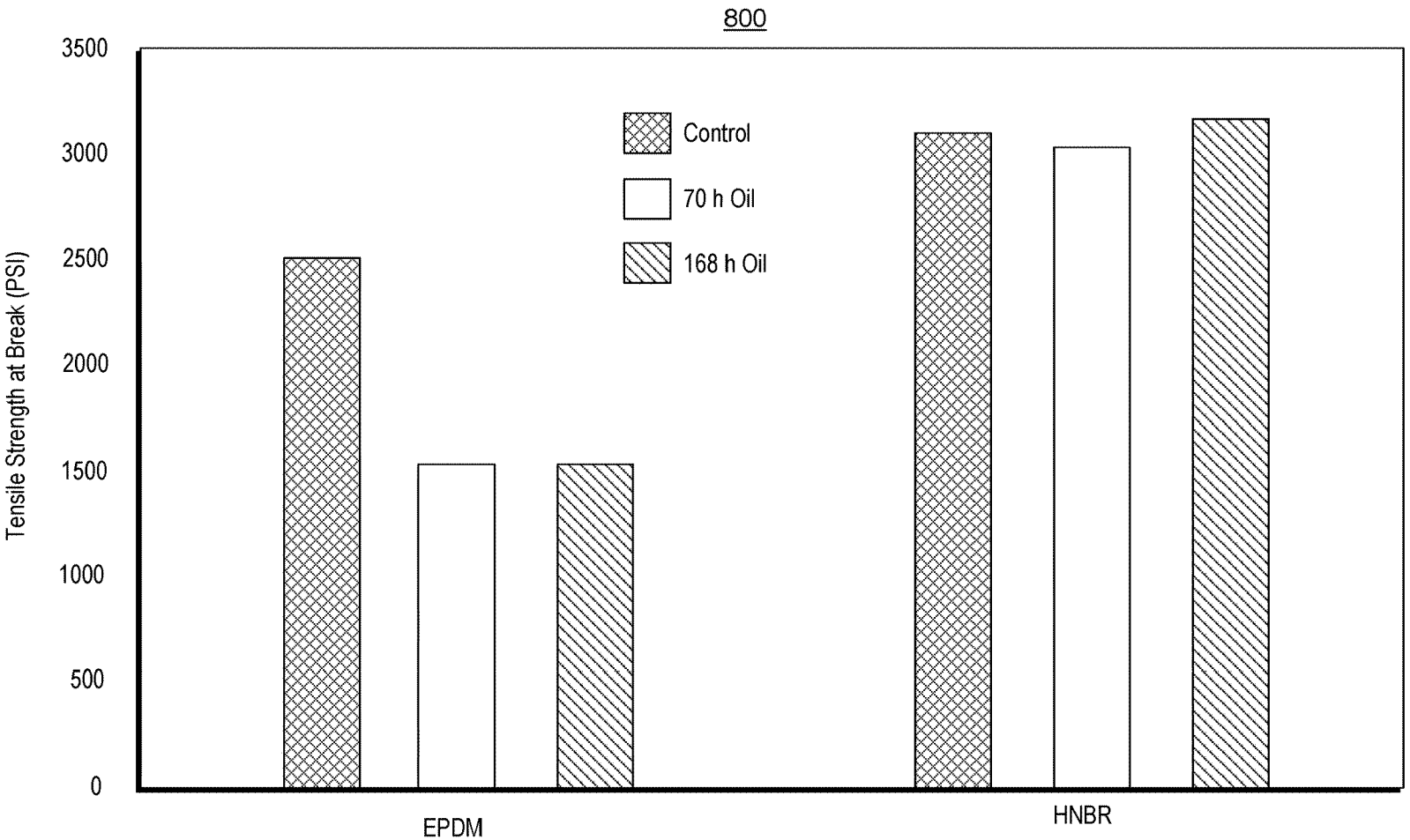
FIG. 8 illustrates an example of a plot.

FIG. 8 shows an example plot 800 of data pertaining to tensile strength with aging of a HNBR material and an EPDM material at 70 hours and at 168 hours in oil (REGAL™ 68 grade oil, Chevron USA Inc., San Ramon, Calif.) at about 177 degrees C. As shown in FIG. 8, the HNBR material has more than twice the tensile strength of the EPDM material after aging.

Figure 9:
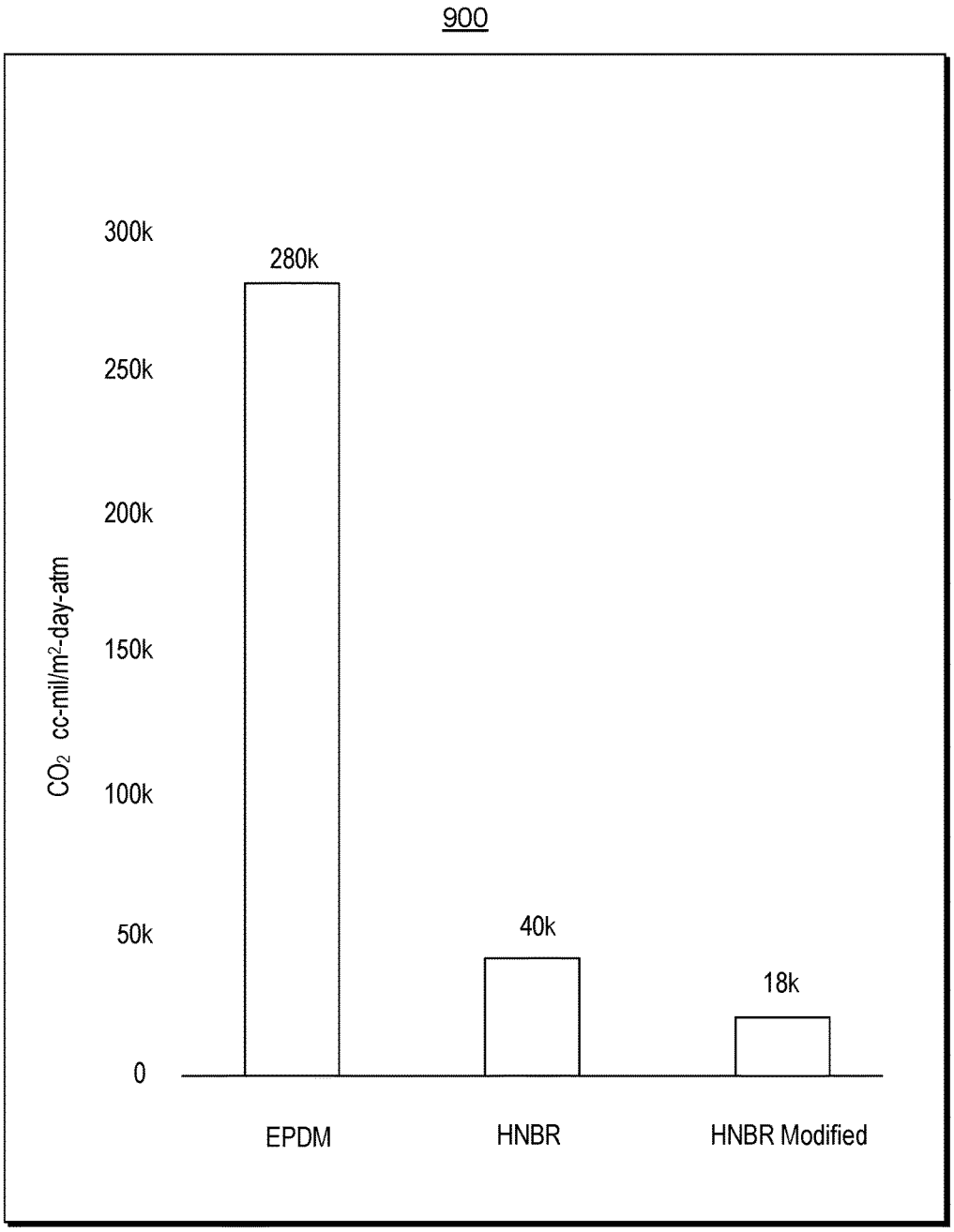
FIG. 9 illustrates an example of a plot.

FIG. 9 shows an example plot 900 of data pertaining to $CO_2$ transmission rate for EPDM, HNBR and a modified HNBR (e.g., HNBR modified) that includes graphene (e.g., graphene nanoplatelets). For example, a modified HNBR may be a composite material that includes platelet particles that have a thickness (e.g., a z dimension) that is about two orders of magnitude less than a two-dimensional plate dimension (e.g., x or y dimension). As an example, consider a modified HNBR that includes about 5 parts per hundred rubber (phr) graphene nanoplatelets.

As an example, a modified polymeric material can include about 1 phr or more of a filler where the filler is dispersed in the polymeric material and where the filler can be plate-like with a thickness dimension (e.g., z dimension) that is less than a minimum plate dimension (e.g., x or y dimension). In such an example, the plate-like filler can be dispersed in a polymeric matrix in a manner that hinders gas transport through the polymeric matrix. As an example, consider an example of a modified polymeric material that includes from about 1 phr filler to about 30 phr filler. As an example, consider such an example, with about 1 phr filler to about 20 phr filler. As an example, consider such an example, with about 1 phr filler to about 15 phr filler. As an example, consider such an example, with about 1 phr filler to about 10 phr filler. In such examples, a filler may optionally include different types of filler. For example, consider a population of one type of graphene nanoplatelets and a population of another type of graphene nanoplatelets.

As an example, an extrusion process may include extruding multiple layers of material where the layers include different amounts of filler, which may differ, be mixtures of fillers, etc. As an example, such an approach may consider radius of a layer and thickness of a layer and include an amount of filler based on a gas transport model for a cylinder or cylinders (e.g., concentric annuli, etc.). As an example, a model for diffusion in a hollow cylinder (e.g., an annular wall) may be utilized to determine an amount of filler (e.g., in phr, etc.) to achieve a desired decrease in rate of gas transport. For example, consider the following equation (Eqn. 1):

$$\frac{\partial c(r, z, t)}{\partial t} = D\nabla^2 c(r, z, t) \quad \text{(Eqn. 1)}$$

for a region or regions (n): $a \le r \le b$ (e.g., consider $r_i$, where i=1 to n) and $0 \le z \le L$.

In such an example, the amount of filler can be related to the diffusion coefficient such that a higher amount of filler in a polymeric material can decrease diffusion of gas (see, e.g., c as concentration of gas) through the polymeric material. In such an example, a number of layers of different amounts of filler may be determined where such amounts and layer thicknesses may aim to provide for suitable mechanical properties and suitable hindrance of gas transport (e.g., gas diffusion). For example, an inner layer may be of a higher phr of filler as it may be of a smaller outer diameter (e.g., radius) while an outer layer may be of a lesser phr of filler as it may be of a larger outer diameter (e.g., radius), which may be subjected to more mechanical stress than the inner layer where, for example, the filler, when present above a certain level, may decrease mechanical properties of a polymeric material. As an example, a determination may utilize one or more boundary conditions, which may correspond to conditions that a cable may be exposed to in a geologic environment (e.g., in a downhole environment such as a well environment, a reservoir environment, etc.).

As shown in FIG. 9, the HNBR has a lesser transmission rate than EPDM and addition of graphene nanoplatelets to HNBR to form a composite material can reduce the transmission rate further. As an example, where gas permeation is expected to be a risk, a cable can include insulation and a shield disposed about the insulation where the shield includes graphene such as, for example, graphene nanoplatelets (GnP). In such an example, the shield can help protect the insulation from exposure to a gas such as $CO_2$.

In some embodiments, a cable construction may include: (a) copper conductor; (b) semiconductive shield layer; (c) insulation layer (e.g., EPDM or cross-linked polyethylene); (d) semiconductive insulation shield layer; (e) conductive metallic shield layer (e.g., metallic braid or tape wrap); (f) cable jacket (e.g., polyethylene); and (g) armor (e.g., galvanized or stainless steel or MONEL™ alloy). In some such embodiments, the cable construction may be rated greater than about 5 kV.

As an example, for a lower voltage application (e.g., less than about 5 kV), a cable may be provided without a semi-conductive conductor shield. In such an example, a HNBR layer as a shield can be optionally without conductive material dispersed therein and, for example, substantially bonded to underlying insulation (e.g., via cross-linking at an interface). In such an example, the HNBR layer may act as an additional dielectric material.

Figure 10:
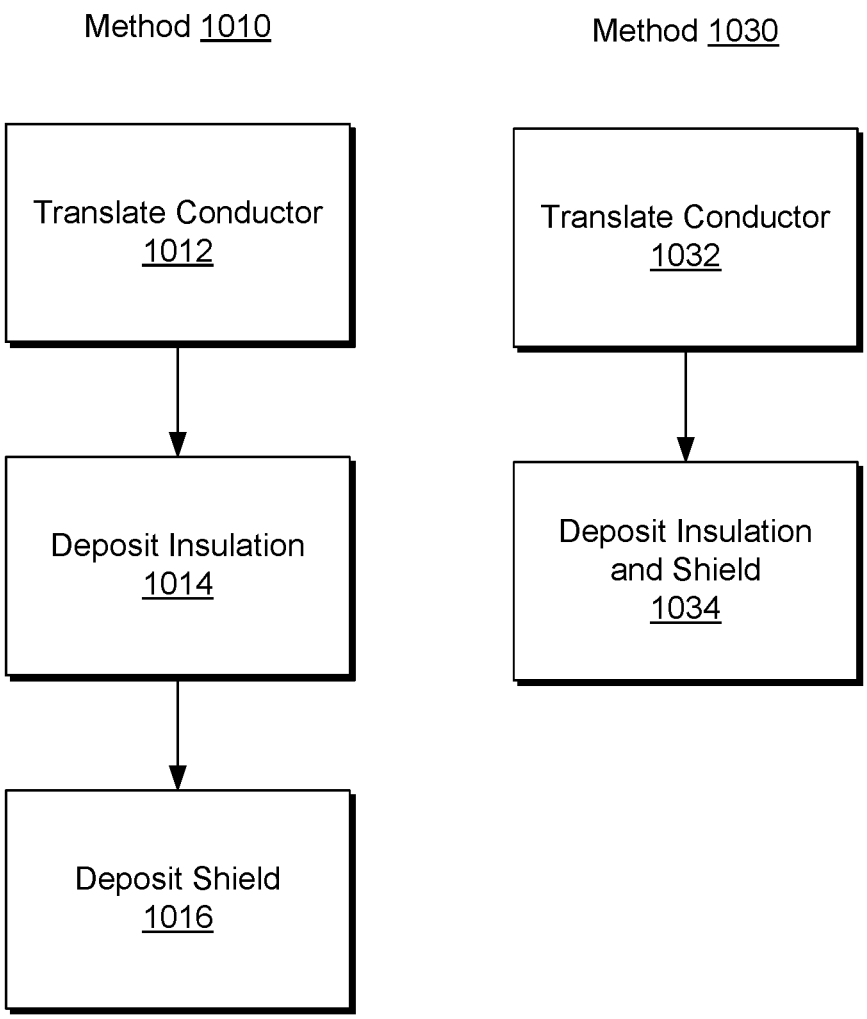
FIG. 10 illustrates examples of methods.

FIG. 10 shows an example of a method 1010 and an example of a method 1030. As shown, the method 1010 includes a translation block 1012 for translating a conductor, a deposition block 1014 for depositing insulation about the conductor and a deposition block 1016 for depositing a shield about the insulation. As to the method 1030, it includes a translation block 1032 for translating a conductor and a deposition block 1034 for depositing insulation and depositing a shield, for example, via a co-extrusion process.

Figure 11:
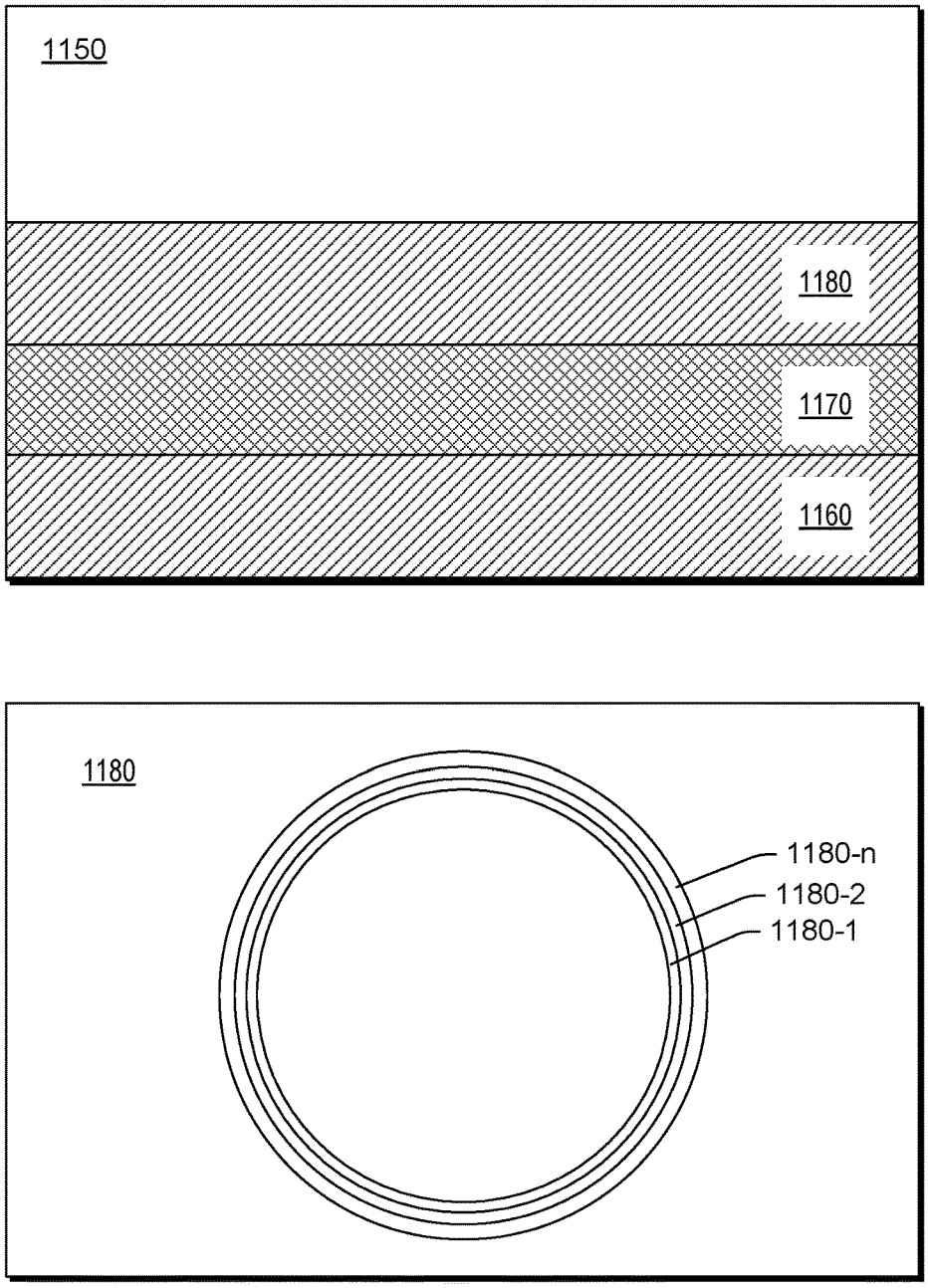
FIG. 11 illustrates an example of a portion of an insulated conductor with a shield.

FIG. 11 shows an example of a cross-section of a portion of a cable 1150 that includes a conductor 1160, an insulation layer 1170 and a shield layer 1180. As an example, such a cable may include one or more other layers, for example, consider a layer between the insulation layer 1170 and the conductor 1160 and/or, for example, one or more layers disposed over the shield layer 1180.

In the example of FIG. 11, the shield layer 1180 may include particles dispersed in a polymeric matrix. In such an example, the particles may alter the conductivity and/or the gas permeability of the shield layer 1180. For example, consider one or more of clay, carbon black and graphene as particles that may be included in the shield layer 1180. As explained, clay can reduce conductivity, a conductive carbon black can increase conductivity and graphene can reduce gas permeability when included in a polymeric material such as, for example, a nitrile rubber (e.g., NBR, HNBR, etc.). As an example, a shield layer may be tailored via addition of one or more materials, which can include conductive and/or non-conductive materials. As an example, a material may be provided as particles, which may be platelets. In such an example, an extrusion process may flow a polymeric composite material in a manner that causes at least a portion of the platelets to align. In such an example, the platelets may align substantially in a direction of flow (e.g., as stacked, staggered plates), which may physically create tortuous paths within the polymeric composite material that act to hinder permeation of chemicals through the polymeric composite material.

As mentioned, a shield layer can include a plurality of shield layers, which may be referred to as sub-layers. For example, FIG. 11 shows the shield layer 1180 as optionally including sublayers 1180-1, 1180-2, to **1180-*n*, where n may be a number of sublayers. In such an example, the sublayers (e.g., two or more) may differ in their properties. For example, one layer may include a different amount of filler than one or more other layers (see, e.g., Eqn. 1 above). As an example, consider the sublayer 1180-1 having a higher phr of graphene nanoplatelets than the sublayer 1180-2 (e.g., or the sublayer 1180-*n*) or, for example, consider the sublayer 1180-1 having a lower phr of graphene nanoplatelets than the sublayer 1180-2 (e.g., or the sublayer 1180-*n***). As mentioned, mechanical properties and/or diffusion coefficients may be taken into account when determining an amount of filler to include in a polymeric material that can be utilized as an insulation shield. As an example, multiple sublayers may be co-extruded and, for example, chemically linked at their interface(s). As an example, two sublayers may have different diffusion coefficients (e.g., $D_1$ and $D_2$) for diffusion of a gas (e.g., $CO_2$, $H_2S$, etc.). In such an example, a diffusion coefficient may differ due to a difference in one or more materials (e.g., polymers and/or fillers) and/or amount of one or more materials.

Figure 12:
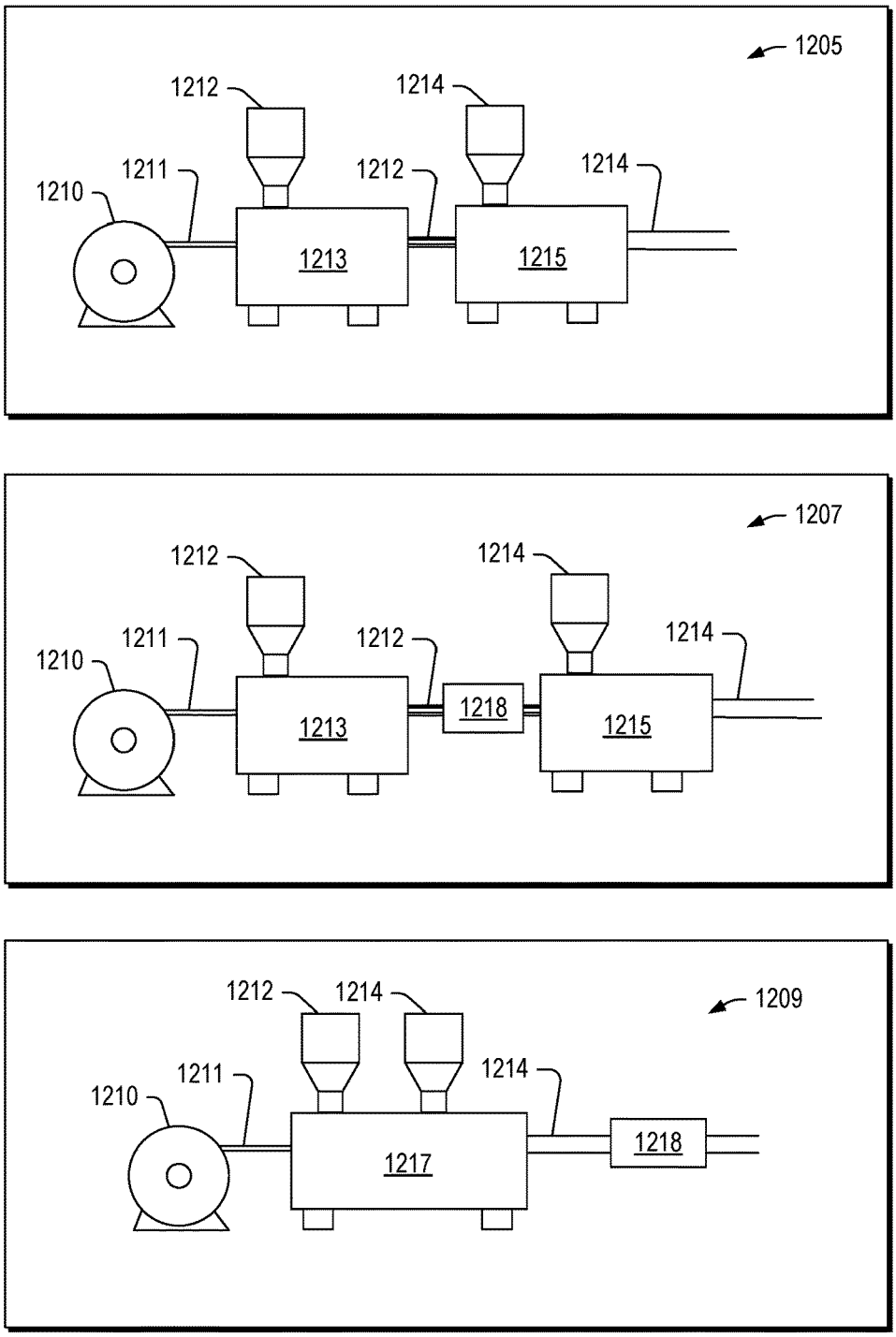
FIG. 12 illustrates examples of processing equipment.

FIG. 12 shows examples of processing equipment 1205, 1207 and 1209. As shown, the processing equipment 1205 can include a reel 1210 that carries a conductor 1211 for translation to a first extruder 1213 fed with a first material 1212 that can be extruded about the conductor 1211 and then translated to a second extruder 1215 fed with a second material 1214 that can be extruded about the first material 1212. In such an example, the conductor 1211 may be coated with a conductor shield or other material. As an example, the processing equipment 1205 can deposit insulation as the first material and can deposit an insulation shield as the second material. In such an example, one or more processing conditions may be adjusted to allow for an amount of surface modification of the first material prior to deposition of the second material. In such an example, the amount of surface modification may correspond to curing of the first material. Such an example may allow for control of an amount of cross-linking of the second material to the first material.

As shown, the processing equipment 1207 can include the reel 1210 that carries the conductor 1211 that can be translated to the first extruder 1213 fed with the first material 1212 that can be extruded about the conductor 1211, and then translated to the second extruder 1215 fed with the second material 1214 that can be extruded about the first material 1212. In such an example, the conductor 1211 may be coated with a conductor shield or other material. The processing equipment 1207 further includes equipment 1218, which may be, for example, one or more types of equipment that can be used to alter properties of the first material 1212. For example, the equipment 1218 can be a hot air oven that can expedite curing of at least a portion of the first material 1212 prior to entry to the second extruder 1215. In such an example, the curing may alter surface properties of the first material 1212 in a manner that impacts cross-linking of the second material 1214 to the first material 1212.

As an example, the processing equipment 1207 can deposit insulation as the first material and can deposit an insulation shield as the second material. In such an example, one or more processing conditions (e.g., optionally of the equipment 1218) may be adjusted to allow for an amount of surface modification of the first material prior to deposition of the second material. In such an example, the amount of surface modification may correspond to curing of the first material. Such an example may allow for control of an amount of cross-linking of the second material to the first material.

As shown in FIG. 12, the processing equipment 1209 includes various components of the processing equipment 1205; however, a single extruder 1217 is included that can co-extrude the first material 1212 and the second material 1214. In such an example, the first and second materials 1212 and 1214 may be deposited in a simultaneous manner about the conductor 1211 as the conductor 1211 is translated through the extruder 1217. In such an example, the conductor 1211 may be coated with a conductor shield or other material.

As shown, the processing equipment 1209 may optionally further include equipment 1218, which may be, for example, one or more types of equipment that can be used to alter properties of the first material 1212 and/or the second material 1214. For example, the equipment 1218 can be a hot air oven that can expedite curing.

As an example, a manufacturing process can include extruding polymeric material and heating the material to about 200 degrees C. or more (e.g., about 392 degrees F. or more) for about several minutes for polymerization, curing, vulcanizing, etc. As an example, a curing temperature may be about 200 degrees C. to about 205 degrees C. (e.g., about 392 degrees F. to about 401 degrees F.).

As an example, heat loss or cooling may occur for extruded material or materials. For example, extruded material may cool approximately to an ambient temperature (e.g., a room temperature of about 5 degrees C. to about 40 degrees C.).

As an example, a process can include post-curing, for example, after passing extruded material through a heater.

As an example, a polymerization process may be characterized at least in part by a curve such as, for example, a vulcanization curve, which can exhibit an increase in viscosity of polymeric material (e.g., insulation) during cross-linking. As an example, a steepness of a curve can be affected by the nature of one or more additives (e.g., accelerator(s), etc.). As an example, a process may control polymerization, extrusion, etc. (e.g., at a particular point in time along a viscosity curve, modulus curve, polymerization curve, etc.). As an example, a curve may correspond to one or more material states of a material (e.g., molten, crystallized, polymerized, etc.).

As an example, processing equipment can include inspection equipment that can inspect layers, etc. at one or more points. For example, inspection equipment may inspect an extruded polymeric insulation layer at point a distance from a die of an extruder and/or inspect an extruded polymeric shield layer at a point a distance from a die of an extruder.

As an example, a single extruder may be utilized, for example, with a single material or with two materials. As an example, the single material or one of the materials can be an insulation that electrically insulates a conductor. As an example, such insulation can be a polymeric material such as, for example, polypropylene (PP), PEEK, EPDM, etc. For example, a polymeric material such as one or more of PP, EPDM, PEEK, PFA, and/or epitaxial co-crystalline (ECC) perfluoropolymer (e.g., DuPont™ ECCtreme™ ECA 3000 fluoroplastic resin), may be used as a dielectric layer. Where two materials are extruded via a single extruder, one of the materials can be a shield material that acts to shield insulation material. As an example, such a shield material can include a nitrile rubber such as, for example, HNBR. In such an example, the two materials may become crosslinked at their interface upon curing of the materials (e.g., polymeric materials therein).

As an example, a polymeric material can be an ethylene propylene diene monomer (M-class) rubber (EPDM). EPDM rubber is a terpolymer of ethylene, propylene, and a diene-component. As an example, ethylene content may be, for example, from about 40 percent to about 90 percent where, within such a range, a higher ethylene content may be beneficial for extrusion.

Figure 13:
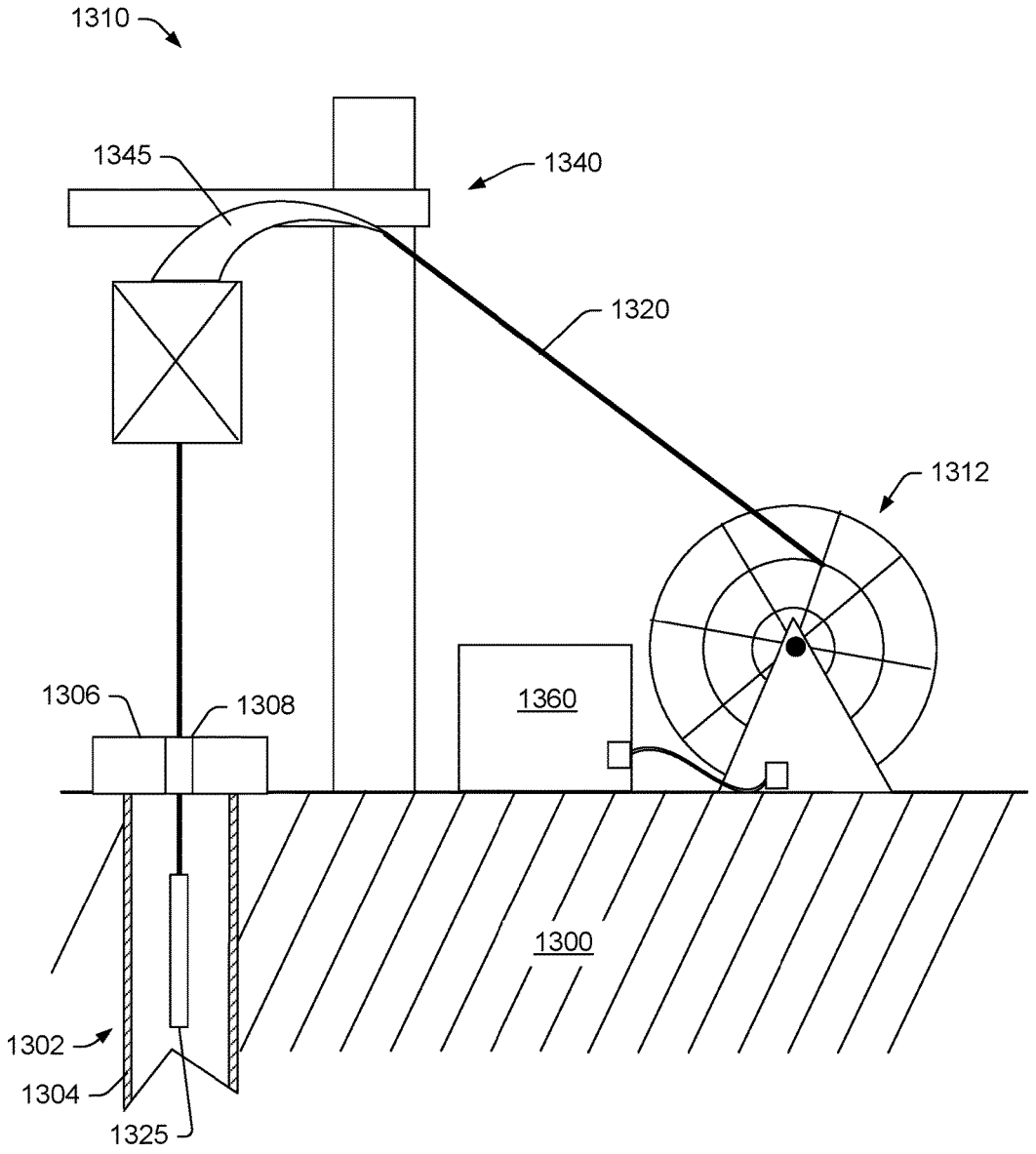
FIG. 13 illustrates an example of a system.

FIG. 13 shows an example of a geologic environment 1300 and a system 1310 positioned with respect to the geologic environment 1300. As shown, the geologic environment 1300 may include at least one bore 1302, which may include casing 1304 and well head equipment 1306, which may include a sealable fitting 1308 that may form a seal about a cable 1320. In the example of FIG. 13, the system 1310 may include a reel 1312 for deploying equipment 1325 via the cable 1320. As an example, the equipment 1325 may be a pump such as an ESP. As an example, the system 1310 may include a structure 1340 that may carry a mechanism such as a gooseneck 1345 that may function to transition the cable 1320 from the reel 1312 to a downward direction for positioning in the bore 1302.

As an example, the cable 1320 may include one or more conductive wires, for example, to carry power, signals, etc. For example, one or more wires may operatively couple to the equipment 1325 for purposes of powering the equipment 1325 and optionally one or more sensors. As shown in the example of FIG. 13, a unit 1360 may include circuitry that may be electrically coupled to the equipment 1325. As an example, the cable 1320 may include or carry one or more wires and/or other communication equipment (e.g., fiber optics, rely circuitry, wireless circuitry, etc.) that may be operatively coupled to the equipment 1325. As an example, the unit 1360 may process information transmitted by one or more sensors, for example, as operatively coupled to or as part of the equipment 1325. As an example, the unit 1360 may include one or more controllers for controlling, for example, operation of one or more components of the system 1310 (e.g., the reel 1312, etc.). As an example, the unit 1360 may include circuitry to control depth/distance of deployment of the equipment 1325.

In the example of FIG. 13, the weight of the equipment 1325 may be supported by the cable 1320. As an example, the cable 1320 may support the weight of the equipment 1325 and its own weight, for example, to deploy, position, retrieve the equipment 1325.

In the example of FIG. 13, the cable 1320 may include insulation and an insulation shield where the insulation and insulation shield are formed of two different polymeric materials where the insulation shield can optionally include one or more types of particles dispersed in the polymeric material.

As an example, the cable 1320 may have a relatively smooth outer surface, which may be a polymeric surface. In such an example, the surface may facilitate deployment and/or sealability, for example, to form a seal about the cable 1320 (e.g., at a wellhead and/or at one or more other locations).

As an example, a power cable can include a conductor; an insulation layer disposed about the conductor where the insulation layer includes a first polymeric material; and a shield layer disposed about the insulation layer where the shield layer includes a second polymeric material where a solubility parameter of the first polymeric material is less than a solubility parameter of the second polymeric material. In such an example, first polymeric material can be or include ethylene propylene diene monomer (M-class) rubber (EPDM) and/or the second polymeric material can be or include hydrogenated nitrile butadiene rubber (HNBR). As an example, a first polymeric material can include ethylene propylene diene monomer (M-class) rubber (EPDM) and the second polymeric material can include hydrogenated nitrile butadiene rubber (HNBR).

As an example, an insulation layer and a shield layer can include chemical cross-links, for example, between a first polymeric material of the insulation layer and a second polymeric material of the shield layer.

As an example, a shield layer can include particles dispersed in a polymeric material. As an example, consider one or more of clay particles, electrically conductive carbon black particles and graphene particles. As an example, where particles include electrically conductive carbon black particles, a shield layer can be a semi-conductive layer. As an example, where particles include graphene particles, such particles can be graphene nanoplatelets (GnPs). As an example, a shield layer can include two or more of clay particles, carbon black particles and graphene particles.

As an example, a power cable can include an insulation layer that has a thickness of at least approximately 1.27 mm (e.g., in a radial dimension from a longitudinal axis of a conductor about which the insulation layer is disposed) and/or a shield layer that has a thickness less than approximately 0.635 mm.

As an example, a power cable can include a conductor; an insulation layer disposed about the conductor where the insulation layer includes a first polymeric material; and a shield layer disposed about the insulation layer where the shield layer includes a second polymeric material where a solubility parameter of the first polymeric material is less than a solubility parameter of the second polymeric material and where the insulation layer that has a thickness that is at least approximately twice a thickness of a shield layer.

As an example, a method can include translating a conductor in an extruder; depositing an insulation layer about the conductor where the insulation layer includes a first polymeric material; and depositing a shield layer about the insulation layer where the shield layer includes a second polymeric material where a solubility parameter of the first polymeric material is less than a solubility parameter of the second polymeric material. In such an example, depositing the insulation layer can include extruding the insulation layer and/or depositing the shield layer can include extruding the shield layer. As an example, a method can include depositing an insulation layer and depositing a shield layer via co-extruding the insulation layer and the shield layer where the shield layer is a barrier layer about the insulation layer that can optionally include one or more types of particles dispersed therein. For example, a shield layer can be a composite material where particles are dispersed in a polymeric matrix. As an example, the particles can include one or more types of particles (e.g., clay, carbon black, graphene, etc.).

As an example, a shield layer can include sublayers. For example, a power cable can include a conductor; an insulation layer disposed about the conductor where the insulation layer includes a first polymeric material; and a shield layer disposed about the insulation layer where the shield layer includes a second polymeric material and where the shield layer includes sublayers, which may differ in their composition. For example, consider sublayers that include different amounts (e.g., phr) of one or more types of particles. In such an example, the different amounts may determine, at least in part, different diffusion coefficients with respect to a gas in each of the sublayers and/or effect one or more mechanical properties of each of the sublayers. As an example, a solubility parameter of a first polymeric material can be less than a solubility parameter of one or more other polymeric materials that are utilized in one or more sublayers of a shield layer. As an example, a shield layer that includes sublayers may be strippable, for example, from an insulation layer and/or with an insulation layer from an electrical conductor about which the insulation layer is disposed.

As an example, an electric submersible pump can include an electric motor; a pump operatively coupled to the electric motor; and a power cable that includes a conductor electrically coupled to the electric motor; an insulation layer disposed about the conductor where the insulation layer includes a first polymeric material; and a shield layer disposed about the insulation layer where the shield layer includes a second polymeric material where a solubility parameter of the first polymeric material is less than a solubility parameter of the second polymeric material. In such an example, the power cable can be rated, for example, with a rating of at least 5 kV. As an example, such a power cable may be a subsea power cable for utilization in a subsea environment.

As an example, one or more methods described herein may include associated computer-readable storage media (CRM) blocks. Such blocks can include instructions suitable for execution by one or more processors (or cores) to instruct a computing device or system to perform one or more actions.

According to an embodiment, one or more computer-readable media may include computer-executable instructions to instruct a computing system to output information for controlling a process. For example, such instructions may provide for output to sensing process, an injection process, drilling process, an extraction process, an application process, an extrusion process, a curing process, a tape forming process, a pumping process, a heating process, etc.

Figure 14:
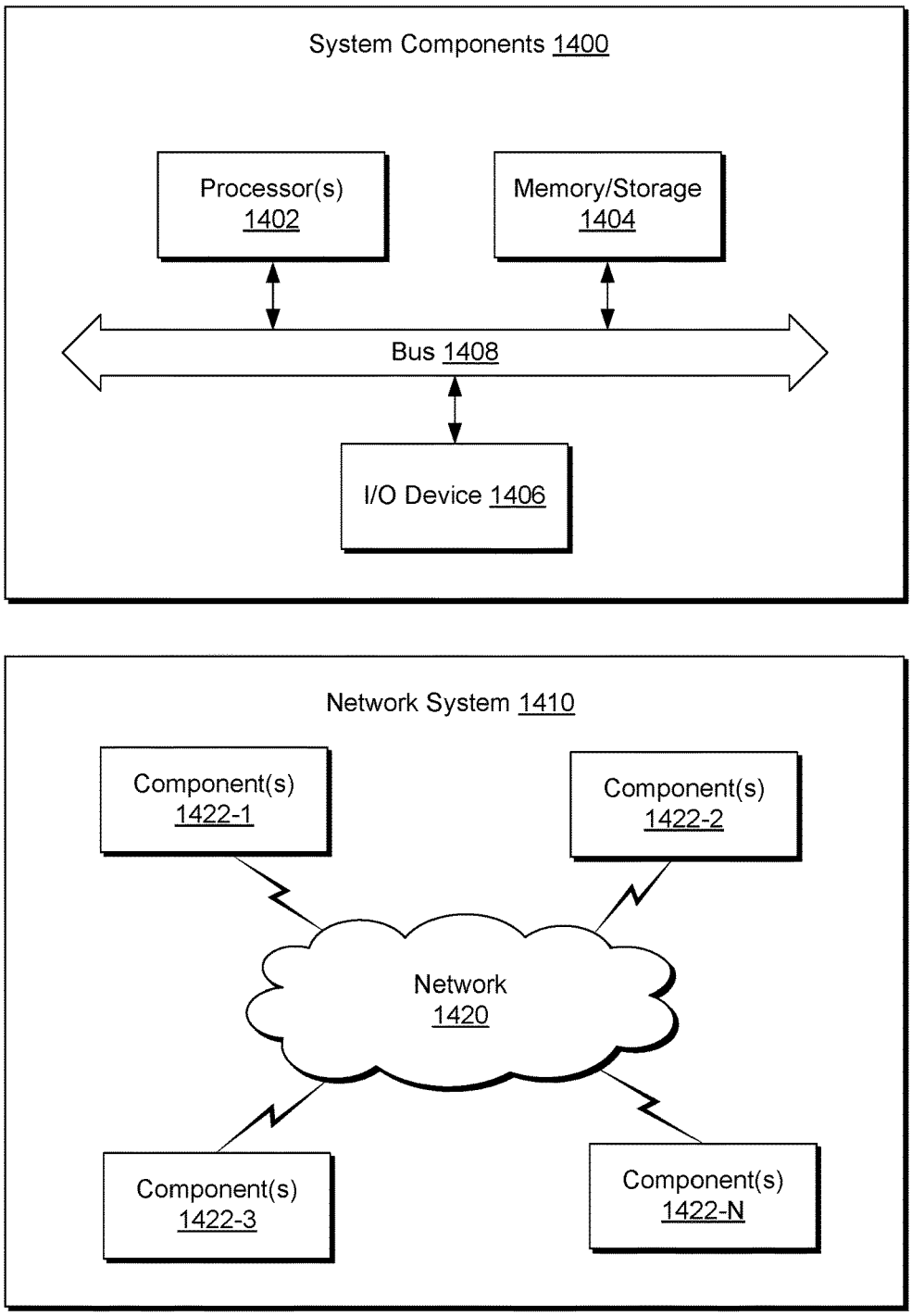
FIG. 14 illustrates example components of a system and a networked system.

FIG. 14 shows components of a computing system 1400 and a networked system 1410. The system 1400 includes one or more processors 1402, memory and/or storage components 1404, one or more input and/or output devices 1406 and a bus 1408. According to an embodiment, instructions may be stored in one or more computer-readable media (e.g., memory/storage components 1404). Such instructions may be read by one or more processors (e.g., the processor(s) 1402) via a communication bus (e.g., the bus 1408), which may be wired or wireless. The one or more processors may execute such instructions to implement (wholly or in part) one or more attributes (e.g., as part of a method). A user may view output from and interact with a process via an I/O device (e.g., the device 1406). According to an embodiment, a computer-readable medium may be a storage component such as a physical memory storage device, for example, a chip, a chip on a package, a memory card, etc.

According to an embodiment, components may be distributed, such as in the network system 1410. The network system 1410 includes components 1422-1, 1422-2, 1422-3, . . . 1422-N. For example, the components 1422-1 may include the processor(s) 1402 while the component(s) 1422-3 may include memory accessible by the processor(s) 1402. Further, the component(s) 1422-2 may include an I/O device for display and optionally interaction with a method. The network may be or include the Internet, an intranet, a cellular network, a satellite network, etc.

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A power cable comprising:

a conductor;

an insulation layer disposed about the conductor wherein the insulation layer comprises a first polymeric material and has a thickness of at least approximately 1.27 mm; and a shield layer disposed about the insulation layer wherein the shield layer comprises a second polymeric material, wherein a solubility parameter of the first polymeric material is less than a solubility parameter of the second polymeric material, the shield layer comprising a plurality of sublayers with each sublayer having a different parts per hundred rubber (phr) of a filler relative to the other sublayers.

2. The power cable of claim 1 wherein the first polymeric material comprises ethylene propylene diene monomer (M-class) rubber (EPDM).

3. The power cable of claim 1 wherein the second polymeric material comprises hydrogenated nitrile butadiene rubber (HNBR).

4. The power cable of claim 1 wherein the first polymeric material comprises ethylene propylene diene monomer (M-class) rubber (EPDM) and wherein the second polymeric material comprises hydrogenated nitrile butadiene rubber (HNBR).

5. The power cable of claim 1 comprising chemical cross-links between the first polymeric material and the second polymeric material.

6. The power cable of claim 1 wherein the filler comprises clay particles.

7. The power cable of claim 1 wherein the filler comprises electrically conductive carbon black particles and wherein the shield layer is a semi-conductive layer.

8. The power cable of claim 1 wherein the filler comprises graphene particles.

9. The power cable of claim 8 wherein the graphene particles comprise graphene nanoplatelets.

10. The power cable of claim 1 wherein the filler comprises two or more of clay particles, carbon black particles and graphene particles.

11. A method comprising:

translating a conductor in an extruder;

depositing an insulation layer about the conductor wherein the insulation layer comprises a first polymeric material which comprises ethylene propylene diene monomer (M-class) rubber (EPDM);

forming a shield layer with a plurality of sublayers each having different properties relative to another of the sublayers; and depositing the shield layer about the insulation layer wherein the shield layer comprises a second polymeric material which comprises hydrogenated nitrile butadiene rubber (HNBR) wherein a solubility parameter of the first polymeric material is less than a solubility parameter of the second polymeric material, wherein the insulation layer comprises a thickness that is at least approximately twice the thickness of the shield layer.

12. The method of claim 11 wherein the depositing the insulation layer comprises extruding the insulation layer.

13. The method of claim 11 wherein the depositing the shield layer comprises extruding the shield layer.

14. The method of claim 11 wherein the depositing the insulation layer and the depositing the shield layer comprises co-extruding the insulation layer and the shield layer.

15. An electric submersible pump comprising:

an electric motor;

a pump operatively coupled to the electric motor; and a power cable that comprises a conductor electrically coupled to the electric motor, the conductor being surrounded by a plurality of extruded layers, the plurality of extruded layers comprising: an insulation layer disposed about the conductor wherein the insulation layer comprises a first polymeric material and has a thickness of at least approximately 1.27 mm; and a shield layer disposed about the insulation layer wherein the shield layer comprises a second polymeric material and has a thickness less than approximately 0.635 mm, wherein a solubility parameter of the first polymeric material is less than a solubility parameter of the second polymeric material, the plurality of extruded layers being extruded with different amounts of filler material selected to provide differing mechanical and gas transport properties.

16. The electric submersible pump of claim 15 wherein the power cable comprises a rating of at least 5 kV.

* * * * *